US008615092B2

(12) United States Patent
Matsuo

(10) Patent No.: US 8,615,092 B2
(45) Date of Patent: Dec. 24, 2013

(54) SOUND PROCESSING DEVICE, CORRECTING DEVICE, CORRECTING METHOD AND RECORDING MEDIUM

(75) Inventor: Naoshi Matsuo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 174 days.

(21) Appl. No.: 12/788,107

(22) Filed: May 26, 2010

(65) Prior Publication Data

US 2010/0232620 A1 Sep. 16, 2010

Related U.S. Application Data

(63) Continuation of application No. PCT/JP2007/072741, filed on Nov. 26, 2007.

(51) Int. Cl.
*H04R 3/00* (2006.01)

(52) U.S. Cl.
USPC ..... 381/92; 381/91; 381/122; 381/95; 381/111; 381/112; 381/1; 381/2; 381/3; 381/97; 381/94.2; 381/94.3; 381/87; 381/57; 381/56; 381/113; 704/225; 704/226

(58) Field of Classification Search
USPC ..... 381/91, 92, 122, 95, 111, 112, 1, 2, 3, 381/97, 94.2, 94.3, 87, 57, 56, 113; 704/225, 226
See application file for complete search history.

(56) References Cited

U.S. PATENT DOCUMENTS 6,385,323 B1 * 5/2002 Zoels ..... 381/313
7,116,791 B2 * 10/2006 Matsuo ..... 381/92
7,274,794 B1 9/2007 Rasmussen
7,587,056 B2 * 9/2009 Zhang ..... 381/94.1
7,619,563 B2 * 11/2009 Taenzer ..... 342/442
8,036,888 B2 * 10/2011 Matsuo ..... 704/233
2005/0276423 A1 * 12/2005 Aubauer et al. ..... 381/92

(Continued)

FOREIGN PATENT DOCUMENTS

DE 19934724 4/2001
EP 1065909 A2 * 1/2001

(Continued)

OTHER PUBLICATIONS

International Search Report for Application No. PCT/JP2007/072741; mailed Mar. 25, 2008.

(Continued)

*Primary Examiner* — Davetta W Goins
*Assistant Examiner* — Kuassi Ganmavo
(74) *Attorney, Agent, or Firm* — Staas & Halsey LLP

(57) ABSTRACT

A sound processing device includes: a plurality of sound input units; a detecting unit for detecting a frequency component of each sound input to the plurality of sound signal unit, the each sound arriving from a direction approximately perpendicular to a line determined by arrangement positions of two sound input units among the plurality of sound input units; a correction coefficient unit for obtaining a correction coefficient for correcting a level of at least one of the sound signals generated from the input sounds by the two sound input units so as to match the levels of the sound signals with each other based on the sound of the detected frequency component; a correcting unit for correcting the level of at least one of the sound signals using the obtained correction coefficient; and a processing unit for performing a sound process based on the sound signal with the corrected level.

15 Claims, 14 Drawing Sheets

(56) References Cited

U.S. PATENT DOCUMENTS

| | | | | |
|---|---|---|---|---|
| 2006/0195324 | A1* | 8/2006 | Birk et al. | 704/275 |
| 2006/0204019 | A1* | 9/2006 | Suzuki et al. | 381/92 |
| 2007/0154031 | A1* | 7/2007 | Avendano et al. | 381/92 |
| 2008/0212804 | A1* | 9/2008 | Watanabe | 381/120 |
| 2009/0136057 | A1* | 5/2009 | Taenzer | 381/74 |
| 2009/0175466 | A1* | 7/2009 | Elko et al. | 381/94.2 |
| 2010/0158267 | A1* | 6/2010 | Thormundsson et al. | 381/92 |

FOREIGN PATENT DOCUMENTS

| | | | |
|---|---|---|---|
| JP | 05022787 | A * | 1/1993 |
| JP | 07-131886 | | 5/1995 |
| JP | 07336790 | A * | 12/1995 |
| JP | 11-153660 | | 6/1999 |
| JP | 2000-188795 | | 7/2000 |
| JP | 2001166025 | A * | 6/2001 |
| JP | 2003075245 | A * | 3/2003 |
| JP | 2004-129038 | | 4/2004 |
| WO | WO 2007098808 | A1 * | 9/2007 |

OTHER PUBLICATIONS

German Office Action dated Mar. 26, 2012 issued in corresponding German Patent Application No. 112007003716.4.

* cited by examiner

SOUND PROCESSING DEVICE, CORRECTING DEVICE, CORRECTING METHOD AND RECORDING MEDIUM

CROSS-REFERENCE TO RELATED APPLICATIONS

This application is a continuation, filed under U.S.C. §111 (a), of PCT International Application No. PCT/JP2007/072741 which has an international filing date of Nov. 26, 2007 and designated the United States of America.

TECHNICAL FIELD

The present invention relates to a sound processing device including a plurality of sound input units to which sounds are input and performing a sound process related to sound based on each sound signal generated from the sound input to each of the plurality of sound input units, a correcting device for correcting a sound signal generated by a sound input device including a plurality of sound input units for generating sound signals from input sounds, a correcting method performed in the sound processing device, and a recording medium storing a computer program for making a computer function as the sound processing device.

BACKGROUND

A sound processing device such as a microphone array including a sound input unit using a microphone such as a condenser microphone and performing various sound processes based on the sound input to the sound input unit has been developed as a device to be incorporated into a system such as a mobile phone, a car navigation system or a conference system. Such a sound processing device performs a sound process such as a process of, for example, performing level control for sound signals generated based on the sound input to the sound input unit in accordance with the distance between the sound processing device and a sound source. By the level control in accordance with the distance from the sound source, the sound processing device may perform various processes such as a process of approximately suppressing a distant noise while maintaining the level of a voice produced by a speaker near the sound input unit and a process of approximately suppressing a neighborhood noise while maintaining the level of a voice produced by a speaker in the distance.

The level control in accordance with the distance from the sound source is performed by utilizing such a characteristic of the sound that the sound from the sound source propagates in the air as a spherical wave while it approaches a plane wave as the propagation distance becomes longer. Accordingly, the level (amplitude) of a sound signal based on an input sound is attenuated inversely proportional to the distance from the sound source. Hence, the longer the distance from the sound source is, the smaller the attenuation rate of a level with respect to a certain distance becomes. Assume that, for example, the first sound input unit and the second sound input unit are arranged with an appropriate interval D along the direction of the sound source, and the distance from the sound source to the first sound input unit is indicated as L while the distance from the sound source to the second sound input unit is indicated as L+D. The difference (ratio) of the levels between the sound input to the first sound input unit and the sound input to the second sound input unit is indicated as $\{1/(L+D)\}/(1/L)$, i.e., $L/(L+D)$. Here, it is estimated that the level difference $L/(L+D)$ increases as the distance L becomes longer, since the distance L with respect to the interval D increases as the distance L from the sound source becomes longer. In the sound processing device, such a characteristic is utilized to approximately realize the level control in accordance with the distance from the sound source by converting each sound signal generated at each of the plurality of sound input units into a component on a frequency axis, obtaining the difference in levels of the sound signals for each frequency, and amplifying/suppressing a sound signal for each frequency in accordance with a distance based on a level difference.

According to the Japanese Laid-open Patent Publication No. 11-153660, a technique related to an acoustic process based on sound processing device including a plurality of sound input units is proposed.

When a process is performed based on the sounds input to a plurality of sound input units, it is desired for a plurality of microphones used as sound input units to have the same sensitivity. In generally-manufactured microphones, however, a sensitivity difference of, for example, approximately ±3 dB is generated even for nondirectional microphones having a comparatively small difference in sensitivity among them, presenting a problem that it may be preferable to correct the sensitivity in use. This causes a problem of increase in manufacturing cost if the sensitivity is corrected by manpower before microphones are mounted on the sound processing device. Moreover, microphones are deteriorated with age, and the degree of the aging deterioration varies for each microphone. Even if the sensitivity is corrected before being mounted, the problem of the sensitivity difference by aging deterioration will not be solved.

SUMMARY

A sound processing device includes: a plurality of sound input units to which sounds are input; a detecting unit for detecting a frequency component of each sound input to the plurality of sound signal unit, the each sound arriving from a direction approximately perpendicular to a line determined by arrangement positions of a first sound input unit and a second input unit among the plurality of sound input units; a correction coefficient unit for obtaining a correction coefficient to be used for correcting a level of at least one of the sound signals generated from the input sounds by the first sound input unit and the second input unit so as to match the levels of the sound signals generated by the first sound input unit and the second sound input unit with each other based on the sound of the detected frequency component; a correcting unit for correcting the level of at least one of the sound signals using the obtained correction coefficient; and a processing unit for performing a sound process based on the sound signal with the corrected level.

The object and advantages of the invention will be realized and attained by the elements and combinations particularly pointed out in the claims. It is to be understood that both the foregoing general description and the following detailed description are exemplary and explanatory and are not restrictive of the embodiment, as claimed.

DESCRIPTION OF EMBODIMENTS

Embodiment 1

Figure 1:
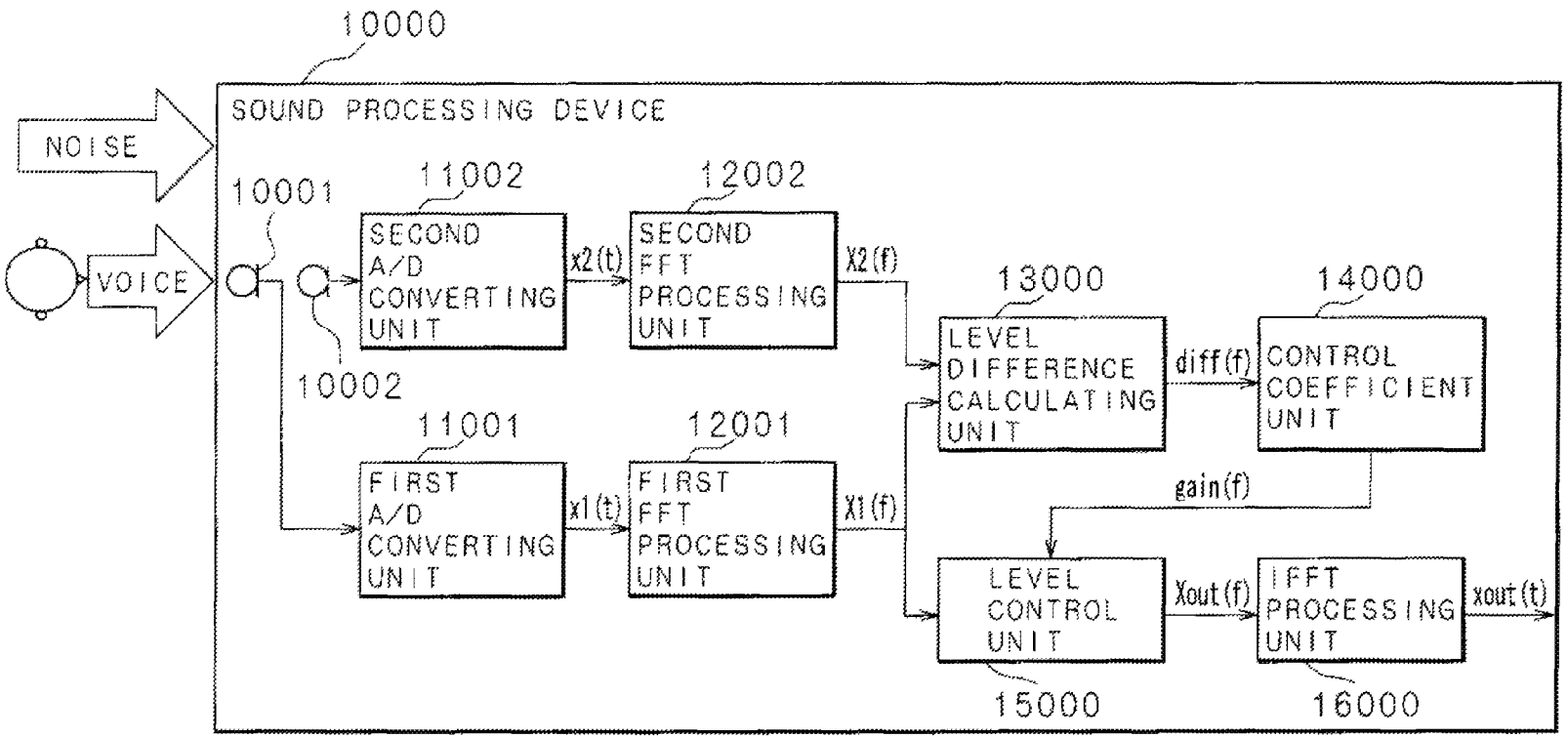
FIG. 1 RELATED ART
FIG. 1 is a functional block diagram illustrating an example of the conventional sound processing device.

FIG. 1 is a functional block diagram illustrating an example of the conventional sound processing device. The sound processing device is denoted by 10000 in FIG. 1. The sound processing device 10000 includes a first sound input unit 10001 and the second sound input unit 10002 for generating sound signals based on input sounds, a first A/D converting unit 11001 and the second A/D converting unit 11002 for performing A/D conversion on the sound signals, a first FFT processing unit 12001 and a second FFT processing unit 12002 for performing FFT (Fast Fourier Transform) processes on the sound signals, a level difference calculating unit 13000 for calculating the difference in levels between the sound signals, a control coefficient unit 14000 for obtaining a control coefficient for controlling the level of a sound signal concerning the first sound input unit 10001, a control unit 15000 for controlling the level of a sound signal concerning the first sound input unit 10001 using the control coefficient, and an IFFT processing unit 16000 for performing an IFFT (Inverse Fast Fourier Transform) process on a sound signal. It is noted that the first sound input unit 10001 and the second sound input unit 10002 are arranged with an appropriate interval along the direction of a sound such as a noise or a voice produced by a speaker.

In FIG. 1, the sound signal generated at the first sound input unit 10001 is indicated as x1(*t*), whereas the sound signal generated at the second sound input unit 10002 is indicated as x2(*t*). Note that the variable t indicates time or a sample number for identifying each sample when a sound signal, which is an analog signal, is sampled and converted into a digital signal. An FFT process is performed at the first FFT processing unit 12001 on the sound signal x1(*t*) generated by the first sound input unit 10001 to obtain a sound signal X1(*f*), whereas an FFT process is performed at the second FFT processing unit 12002 on the sound signal x2(*t*) generated by the second sound input unit 10002 to obtain a sound signal X2(*f*). Note that the variable f indicates frequency. The level difference calculating unit 13000 calculates a level difference diff(f) between the sound signals X1(*f*) and X2(*f*) by the formula (1) below as a ratio of amplitude spectra.

$$\mathrm{diff}(f)=|X2(f)|/|X1(f)| \qquad \text{formula (1)}$$

The control coefficient unit 14000 obtains a control coefficient gain(f) based on the level difference diff(f) by a given calculation method in which, for example, a smaller value is obtained as diff(f) increases, i.e., as the distance to the sound source becomes longer. The level control unit 15000 controls the level of the sound signal X1(*f*) by the control coefficient ping) using the formula (2), to obtain a sound signal Xout(f).

$$X\mathrm{out}(f)=\mathrm{gain}(f)\cdot X1(f) \qquad \text{formula (2)}$$

The IFFT processing unit 16000 then converts, by an IFFT process, the sound signal Xout(f) into a sound signal xout(t) which is a signal on a time axis. The sound processing device 10000 executes various processes such as output of sound based on the sound signal xout (t).

Figure 2:
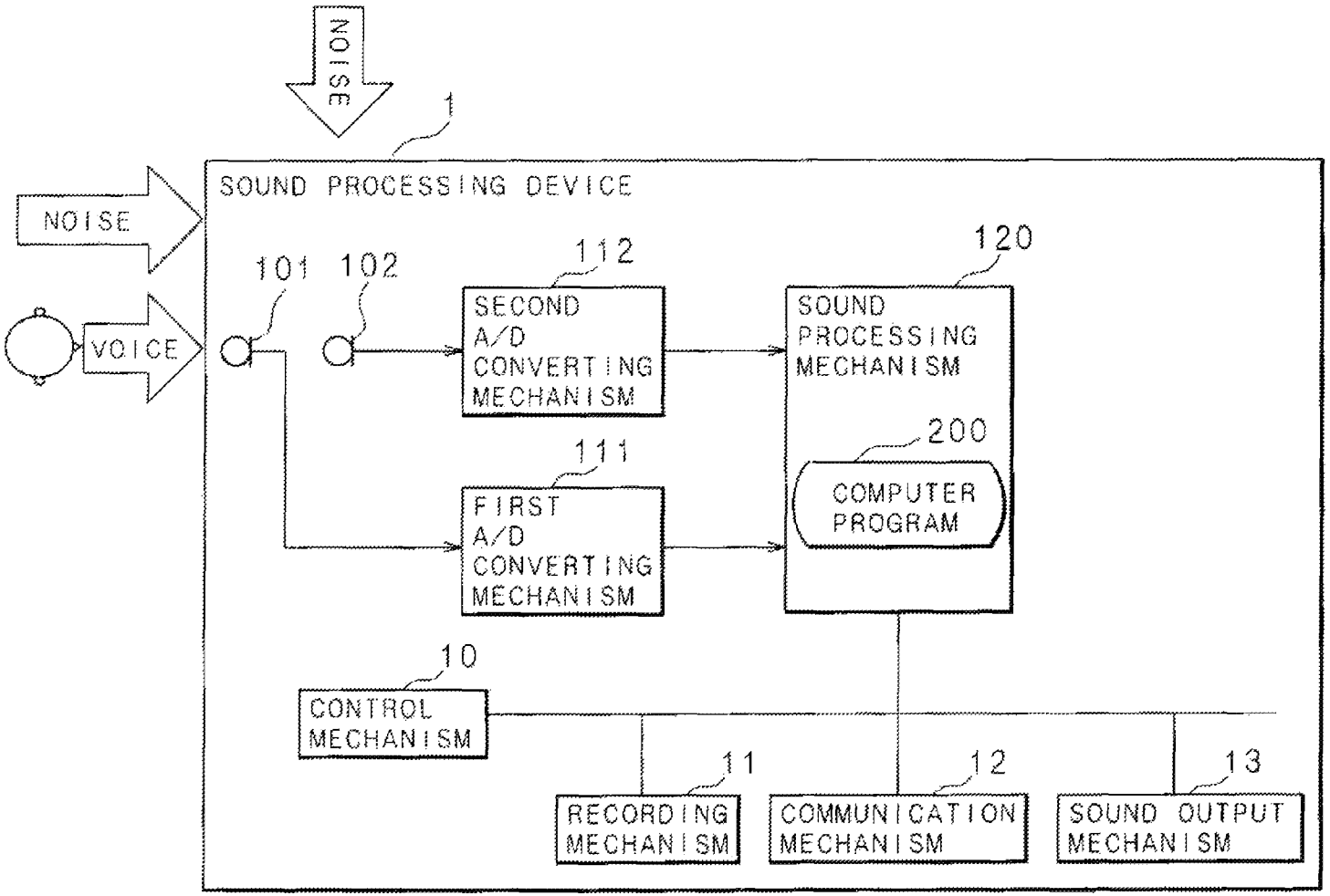
FIG. 2 is a block diagram schematically illustrating an example of a sound processing device according to Embodiment 1.

FIG. 2 is a block diagram schematically illustrating an example of a sound processing device according to Embodiment 1. A sound processing device applied to a device such as a mobile phone is denoted by 1 in FIG. 2. The sound processing device 1 includes a first sound input mechanism 101 and a second sound input mechanism 102 using microphones such as condenser microphones for generating sound signals based on input sounds, a first A/D converting mechanism 111 and a second A/D converting mechanism 112 for performing A/D conversion on the sound signals, and a sound processing mechanism 120 such as a DSP (Digital Signal Processor) in which firmware such as a computer program 200 of the present embodiment and data are incorporated.

The first sound input mechanism 101 and the second sound input mechanism 102 are arranged with an appropriate interval between them along the arrival direction of the sound from a target sound source, such as the direction to the mouth of a speaker who holds the sound processing device 1. Each of the first sound input mechanism 101 and the second sound input mechanism 102 generates a sound signal, which is an analog signal, based on the sound input to each of the first sound input mechanism 101 and the second sound input mechanism 102, and outputs the generated sound signal to each of the first AID converting mechanism 111 and the second A/D converting mechanism 112. Each of the first A/D converting mechanism 111 and the second A/D converting mechanism 112 amplifies the input sound signal by an amplifying function such as a gain amplifier, filters the signal by a filtering function such as LPF (Law Pass Filter), converts the signal into a digital signal by sampling it at sampling frequency of 8000 Hz, 12000 Hz or the like, and outputs the sound signal converted into a digital signal to the sound processing mechanism 120. The sound processing mechanism 120 executes the computer program 200 incorporated therein as firmware to make a mobile phone function as the sound processing device 1 of the present embodiment.

The sound processing device 1 further includes various mechanisms, e.g., a control mechanism 10 such as a CPU (Central Processing Unit) for controlling the whole device, a recording mechanism 11 such as ROM or RAM for recording various programs and data, a communication mechanism 12 such as an antenna and its ancillary equipment, and a sound output mechanism 13 such as a speaker for outputting a sound, so as to execute various processes as a mobile phone.

Figure 3:
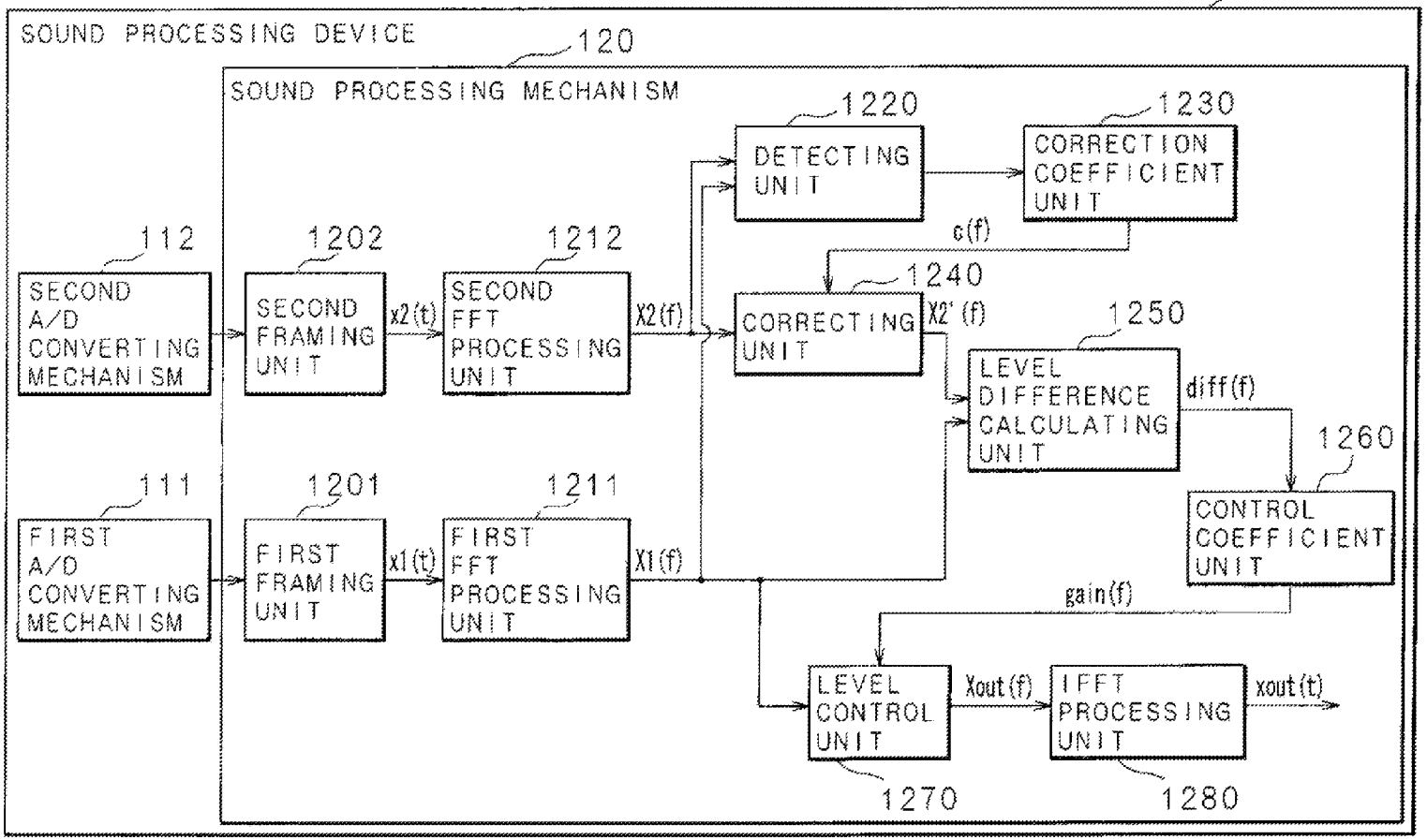
FIG. 3 is a functional block diagram illustrating an example of a sound processing mechanism included in the sound processing device according to Embodiment 1.

FIG. 3 is a functional block diagram illustrating an example of a sound processing mechanism 120 included in the sound processing device 1 according to Embodiment 1. The sound processing mechanism 120 executes the computer program 200 to generate various program modules such as a first framing unit 1201 and a second framing unit 1202 for framing sound signals, a first FFT processing unit 1211 and a second FFT processing unit 1212 for performing FFT processes on sound signals, a detecting unit 1220 for detecting a noise, a correction coefficient unit 1230 for obtaining a correction coefficient to be used for correcting the level of a sound signal, a correcting unit 1240 for correcting the level of a sound signal, a level difference calculating unit 1250 for calculating the difference in levels between sound signals, a control coefficient unit 1260 for obtaining a control coefficient to be used for controlling the level of a sound signal, a level control unit 1270 for controlling the level of a sound signal, and an IFFT processing unit 1280 for performing an IFFT process on a sound signal.

The signal processing for a sound signal by various functions illustrated in FIG. 3 will be described. The sound processing mechanism 120 receives sound signals x1(*t*) and x2(*t*) which are digital signals from the first A/D converting mechanism 111 and the second A/D converting mechanism 112. The first framing unit 1201 and the second framing unit 1202 receive sound signals output from the first A/D converting mechanism 111 and the second A/D converting mechanism 112, respectively, and frame the received sound signals x1(*t*) and x2(*t*) in units, each unit having a given length of, for example, 20 ms to 30 ms. Frames overlap with one another by 10 ms to 15 ms. For each frame, a framing process which is general in the field of voice recognition, such as a window function with a humming window or a hanning window, or filtering by a high-emphasis filter, is performed. Note that the variable t concerning a signal indicates a sample number for identifying each sample when a signal is converted into a digital signal.

The first FFT processing unit 1211 and the second FFT processing unit 1212 perform FFT processes on the framed sound signals, to generate sound signals X1(*f*) and X2(*f*) which are converted into components on the frequency axis, respectively. Note that the variable t indicates frequency.

The detecting unit 1220 detects a sound arriving from the direction approximately perpendicular to the straight line determined by the arrangement positions of the first sound input mechanism 101 and the second sound input mechanism 102, based on the sound signals X1(*f*) and X2(*f*) which are converted into components on the frequency axis. As described earlier, the first sound input mechanism 101 and the second sound input mechanism 102 are arranged along the arrival direction of the sound from a target sound source. Hence, it is estimated that the sound arriving from the direction approximately perpendicular to the straight line determined by the arrangement positions of the first sound input mechanism 101 and the second sound input mechanism 102 is a sound generated by a sound source other than the target sound source, i.e., a noise. Note that the detection of a noise is performed for each frequency component. The arrival direction may be detected based on the phase difference between sounds arrived at the first sound input mechanism 101 and the second sound input mechanism 102. For the noise arriving from the direction approximately perpendicular to the straight line determined by the arrangement positions of the first sound input mechanism 101 and the second sound input mechanism 102, the sound of a component at the frequency f realizing the formula (3) below may be detected as the sound arriving from the approximately perpendicular direction, since the noise arriving from the direction approximately perpendicular to the straight line determined by the arrangement positions of the first sound input mechanism 101 and the second sound input mechanism 102 has a phase difference of 0 or a value approximate to 0.

$$\tan^{-1}(X1(f)/X2(f))\approx 0 \qquad \text{formula 3}$$

wherein X1(*f*), X2(*f*): sound signals converted into components on the frequency axis $\tan^{-1}$ (X1(*f*)/X2(*f*)) ratio of phase spectra for sound signals When the range of the direction approximately perpendicular to the straight line determined by the arrangement positions of the first sound input mechanism 101 and the second sound input mechanism 102 is set as within the range of a given angle A1 from the perpendicular direction, the detecting unit 1220 detects the sound of a component at the frequency f realizing the formula (4) below which is varied from the formula (3) above.

$$|\tan^{-1}(X1(f)/X2(f))|\leq\tan^{-1}(A1) \qquad \text{formula (4)}$$

At the formula (4), the given angle $\tan^{-1}$(A1) is a constant appropriately set in accordance with various factors such as a purpose of use and a shape of the sound processing device 1, and arrangement positions of the first sound input mechanism 101 and the second sound input mechanism 102.

The correction coefficient unit 1230 obtains, for the components of the sound signals X1(*f*) and X2(*f*) concerning the frequency f detected at the detecting unit 1220, a correction coefficient c(f, n) so as to match the levels (amplitude) of the sound signals X1(*f*) and X2(*f*) concerning the first sound input mechanism 101 and the second sound input mechanism 102 with each other by the calculation using the formula (5) below.

$$c(f,n)=\alpha\cdot c(f,n-1)+(1-\alpha)\cdot(|X1(f,n)|/|X2(f,n)|) \qquad \text{formula (5)}$$

wherein c(f, n): correction coefficient

α: $0\leq\alpha\leq 1$ n: frame number

|X1(*f, n*)|/|X2(*f, n*)|: ratio of amplitude spectra for sound signals

The formula (5) is a formula for obtaining the correction coefficient c(f, n) to be used for correcting the level of the sound signal X2(*f*) concerning the second sound input mechanism 102 so as to match the levels of the sound signals X1(*f*) and X2(*f*) concerning the first sound input mechanism 101 and the second sound input mechanism 102 with each other. Note that the constant α is a constant to be used for smoothing, which is performed in order to prevent the level difference between frequencies from being extremely large by the correction using the correction coefficient c(f, n). In the formula (5), since the smoothing in the direction of the time axis is intended, a correction coefficient c(f, n−1) for an immediately preceding frame n−1 is used, while the correction coefficient of the frame n to be obtained is indicated as c(f, n). In the description below, it will be indicated as a correction coefficient c(f) with the frame number being omitted.

The correcting unit 1240 corrects, by the formula (6) below, the level of the sound signal X2(*f*) concerning the second sound input mechanism 102 based on the correction coefficient c(f) obtained at the correction coefficient unit 1230.

$$X2'(f)=c(f)\cdot X2(f) \qquad \text{formula (6)}$$

wherein X2'(*f*): sound signal on which level correction is performed

Correction performed by the correction coefficient unit 1230 and the correcting unit 1240 allows the difference in sensitivity between the first sound input mechanism 101 and the second sound input mechanism 102 to be corrected, making it possible to adjust the variation in quality within a standard generated at the time of manufacturing of microphones and the difference in sensitivity generated by aging deterioration. Though an example has been described as Embodiment 1 where the level of the sound signal X2(*f*) concerning the second sound input mechanism 102 is corrected, the present embodiment is not limited thereto. The level of the sound signal X1(*f*) concerning the first sound input mechanism 101 may be corrected, or both the sound signal X1(*f*) concerning the first sound input mechanism 101 and the sound signal X2(*f*) concerning the second sound input mechanism 102 may also be corrected.

The level difference calculating unit 1250 calculates the level difference diff(f) between the sound signal X1(*f*) concerning the first sound input mechanism 101 and the sound signal X2'(*f*) concerning the second sound input mechanism 102 obtained after correction as a ratio of amplitude spectra by the formula (7) below.

$$\mathrm{diff}(f)=|X2'(f)|/|X1(f)| \qquad \text{formula (7)}$$

wherein diff(f): level difference

The control coefficient unit 1260 obtains a control coefficient gain (f) for controlling the sound signal X1(*f*) concerning the first sound input mechanism 101 based on the level difference diff(f).

Figure 4:
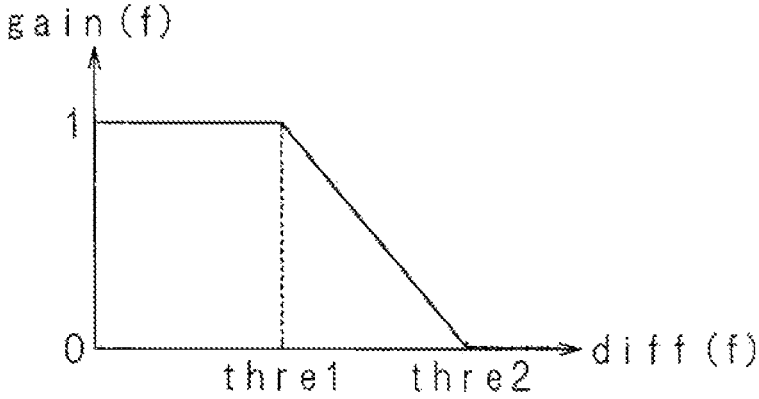
FIG. 4 is a graph illustrating a way of obtaining a control coefficient of the sound processing device according to Embodiment 1.

FIG. 4 is a graph illustrating a way of obtaining the control coefficient gain(f) of the sound processing device 1 according to Embodiment 1. FIG. 4 illustrates the relationship between the level difference diff(f) indicated on the horizontal axis and the control coefficient gain(f) indicated on the vertical axis. FIG. 4 indicates a method of obtaining the control coefficient gain(f) based on the level difference diff(f) by the control coefficient unit 1260, as the relationship between the level difference diff(f) and the control coefficient gain(f). If the level difference diff(f) is a value smaller than a first threshold thre1, the control coefficient gain(f) takes 1. If the level difference diff(f) is equal to or larger than the first threshold thre1 and smaller than a second threshold thre2, the control coefficient gain(f) takes a value equal to or larger than 0 and smaller than 1 which decreases in accordance with the increase of the level difference diff(f). If the level difference diff(f) is equal to or larger than the second threshold thre2, the control coefficient gain(f) takes 0. Hence, when the control coefficient gain(f) is obtained by the method illustrated in FIG. 4, control is performed such that the sound signal X1(*f*) is suppressed as the level difference diff(f) increases if the level difference diff(f) is equal to or larger than the first threshold thre1, whereas an output based on the sound signal X1(*f*) becomes 0 if the level difference diff(f) is equal to or larger than the second threshold thre2.

Since the first sound input mechanism 101 and the second sound input mechanism 102 are arranged along the direction to a speaker's mouth which is a target sound source as described earlier, the target sound source exists in the direction of the straight line determined by the first sound input mechanism 101 and the second sound input mechanism 102. The speaker's mouth which is the target sound source is placed near the first sound input mechanism 101, so that the voice produced by the speaker propagates in the air as a spherical wave. This lowers the level of the sound input to the second sound input mechanism 102 compared to the sound input to the first sound input mechanism 101 due to attenuation during propagation, resulting in a smaller level difference diff(f) defined by the formula (7). On the other hand, a noise generated far from the speaker's mouth becomes closer to a plane wave compared to the voice produced by the speaker even if the sound arrives from the direction of the straight line determined by the first sound input mechanism 101 and the second sound input mechanism 102. Thus, for a noise, attenuation during propagation in the sound input to the second sound input mechanism 102 is smaller than that in the sound input to the first sound input mechanism 101 compared to that of a voice produced by a speaker, resulting in a larger level difference diff(f) defined by the formula (7). Accordingly, by using the method illustrated in FIG. 4 to obtain the control coefficient gain(f), a sound estimated as a noise arriving from a distance may be suppressed.

The level control unit 1270 controls the level of the sound signal X1(*f*) concerning the first sound input mechanism 101 by the formula (8) below based on the control coefficient gain(f) obtained at the control coefficient unit 1260.

$$X\mathrm{out}(f)=\mathrm{gain}(f)\cdot X1(f) \qquad \text{formula (8)}$$

Xout(f): sound signal on which level control is performed

IFFT processing unit 1280 converts the sound signal Xout (f), on which the level control is performed using the control coefficient gain(f), into a sound signal xout(t), which is a signal on a time axis, by an IFFT processing. The sound processing device 1 then performs various processes such as transmission of the sound signal xout(t) from the communication mechanism 12, output of a sound based on the sound signal xout(t) from the sound output mechanism 13, and the other acoustic processes by the sound processing mechanism 120. In the output process based on the sound signal xout(t), processes such as a D/A converting process for converting the signal into an analog signal and an amplifying process are performed as necessary.

Figure 5:
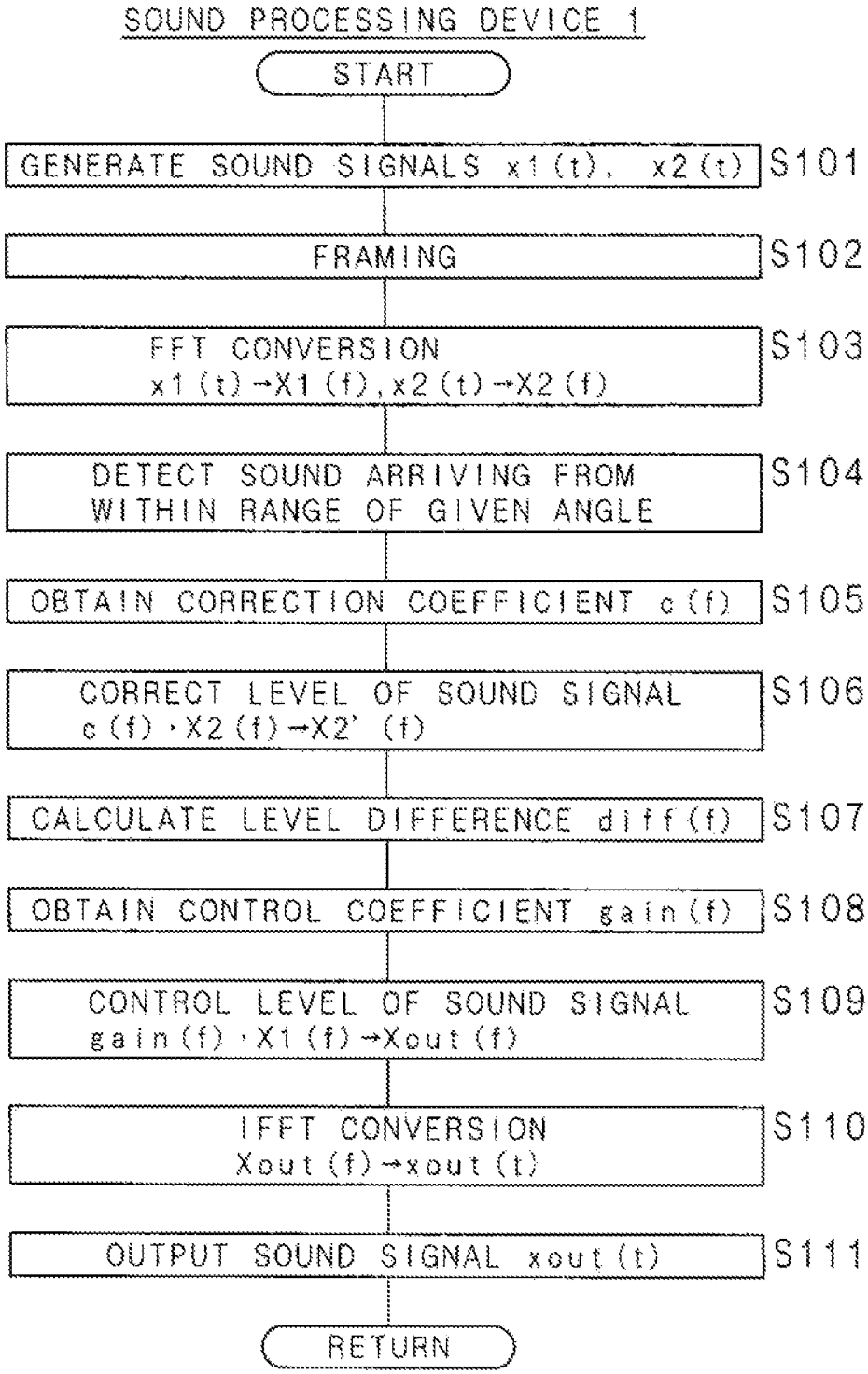
FIG. 5 is an operation chart illustrating an example of a basic process for the sound processing device according to Embodiment 1.

Next, a process performed by the sound processing device 1 according to Embodiment 1 will be described. FIG. 5 is an operation chart illustrating an example of a basic process for the sound processing device 1 according to Embodiment 1. The sound processing device 1 generates sound signals x1(*t*) and x2(*t*) based on the sounds input to the first sound input mechanism 101 and the second sound input mechanism 102, respectively (S101), converts the generated sound signals x1(*t*) and x2(*t*) into digital signals by the first A/D converting mechanism 111 and the second A/D converting mechanism 112, and outputs them to the sound processing mechanism 120.

The sound processing mechanism 120 included in the sound processing device frames the input sound signals x1(*t*) and x2(*t*) by the first framing unit 1201 and the second framing unit 1202 (S102), and converts the framed sound signals x1(*t*) and x2(*t*) into sound signals X1(*f*) and X2(*f*) which are components on the frequency axis by the first FFT processing unit 1211 and the second FFT processing unit 1212 (S103). At the operation S103, it is not always necessary to use FFT for converting the signals into components on the frequency axis, but another frequency converting method such as DCT (Discrete Cosine Transform) may also be used.

The sound processing mechanism 120 included in the sound processing device 1 detects, by the detecting unit 1220, the sound arriving from the direction approximately perpendicular to the straight line determined by the arrangement positions of the first sound input mechanism 101 and the second sound input mechanism 102, more specifically the sound arriving from within a range of a given angle A1 which has been preset on the basis of the direction perpendicular to the straight line based on the sound signals X1(*f*) and X2(*f*) converted into components on the frequency axis (S104). At the operation S104, the arrival direction of a sound is detected for each component concerning the frequency f.

The sound processing mechanism 120 included in the sound processing device 1 obtains, for the components of the sound signals X1(*f*) and X2(*f*) concerning the frequency f, which is detected at the detecting unit 1220, the correction coefficient c(f) so as to match the levels (amplitude) of the sound signals X1(*f*) and X2(*f*) concerning the first sound input mechanism 101 and the second sound input mechanism 102 with each other by the correction coefficient unit 1230 (S105), and corrects the level of the sound signal X2(*f*) concerning the second sound input mechanism 102 based on the correction coefficient c(f) by the correcting unit 1240 (S106). The correction at the operation 5106 allows the difference in sensitivity between the first sound input mechanism 101 and the second sound input mechanism 102 to be corrected.

The sound processing mechanism 120 included in the sound processing device 1 calculates, by the level difference calculating unit 1250, the level difference diff(f) between the sound signal X1(*f*) concerning the first sound input mechanism 101 and the sound signal X2'(*f*) concerning the second sound input mechanism 102 obtained after correction (S107).

The sound processing mechanism 120 included in the sound processing device 1 obtains, by the control coefficient unit 1260, the control coefficient gain(f) for controlling the sound signal X1(*f*) concerning the first sound input mechanism 101 based on the level difference diff(f) (S108), and controls the level of the sound signal X1(*f*) concerning the first sound input mechanism 101 based on the control coefficient gain(f) by the level control unit 1270 (S109). The control at the operation S109 suppresses a noise arriving from a distance.

The sound processing mechanism 120 included in the sound processing device 1 converts, by the IFFT processing unit 1280, the sound signal Xout(f) for which the level is controlled using the control coefficient gain(f) into a sound signal xout(t) which is a signal on the time axis by the IFFT process (S110), and outputs the sound signal xout(t) obtained after conversion (S111).

In the basic process described with reference to FIG. 5, processes from the detection of the arrival direction of a sound performed at the operation S104 to the control of the level of the sound signal X1(*f*) performed at the operation S109 are executed for each frequency f. Specifically, the processes from obtaining of the correction coefficient c(f) performed at the operation S105 to the control of the level of the sound signal X1(*f*) performed at the operation S109 are executed for the sound arriving from the direction approximately perpendicular to the straight line determined by the arrangement positions of the first sound input mechanism 101 and the second sound input mechanism 102, more specifically, for a component of the sound arriving from within the range of a given angle A1 which is preset on the basis of the direction perpendicular to the straight line.

Though Embodiment 1 above described a method of detecting the sound arriving from the direction approximately perpendicular to the straight line determined by the arrangement positions of the first sound input mechanism and the second sound input mechanism as a noise, it may be developed to various forms such as a method of detecting a noise based on a change in power of a sound signal concerning each of the first sound input mechanism and the second sound input mechanism.

Moreover, though Embodiment 1 above described an example where the level of a sound signal is controlled in accordance with the arriving distance after correction of the difference in sensitivity between the first sound input mechanism and the second sound input mechanism, it may be developed to various forms such that each sound signal obtained after correction of the difference in sensitivity may be used for another signal processing.

Furthermore, though Embodiment 1 above described an example where two sound input mechanisms are used, it may be developed to various forms such that three or more sound input mechanisms are used.

The present embodiment may, for example, prevent the manufacturing cost from increasing compared to the case where, e.g., manpower is used for the correction of sensitivity, since the correction of sensitivity for a sound input unit becomes unnecessary when a plurality of sound input units are used, presenting a beneficial effect. Moreover, the present embodiment may also readily address, for example, the aging deterioration of a sound input unit, presenting a beneficial effect.

The present embodiment may perform various sound processes such as a process of approximately suppressing a distant noise while maintaining the level of a voice produced by a speaker near a sound input unit, for example, and a process of approximately suppressing a neighborhood noise while maintaining the level of a voice produced by a speaker in the distance, presenting a beneficial effect.

Embodiment 2

Embodiment 2 describes an example where, in Embodiment 1, processes such as correction of the difference in sensitivity and control of levels are properly executed even if the direction of a target sound source is inclined from the direction of the straight line determined by the arrangement positions of the first sound input mechanism and the second sound input mechanism, to properly execute processes regardless of the posture of a speaker who holds the sound processing device, i.e., a mobile phone. In the description below, the parts similar to those in Embodiment 1 are denoted by reference symbols similar to those of Embodiment 1, and will not be described in detail.

Figure 6:
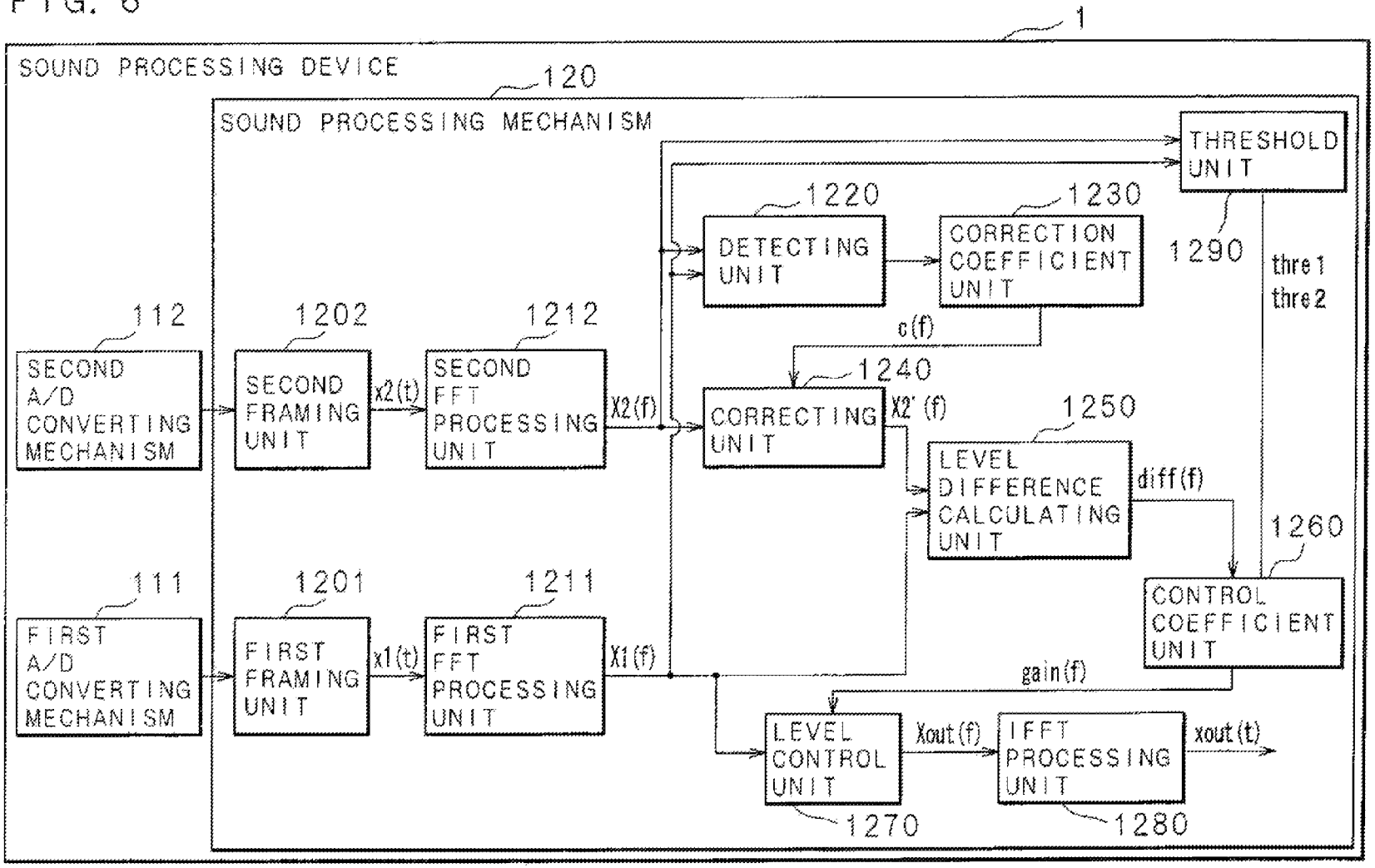
FIG. 6 is a functional block diagram illustrating an example of a sound processing mechanism included in a sound processing device according to Embodiment 2.

Since the configuration example of the sound processing device 1 according to Embodiment 2 is similar to that of Embodiment 1, reference shall be made to Embodiment 1 and description thereof will not be repeated here. FIG. 6 is a functional block diagram illustrating an example of the sound processing mechanism 120 included in the sound processing device 1 according to Embodiment 2. The sound processing mechanism 120 executes the computer program 200 to generate various program modules such as the first framing unit 1201, the second framing unit 1202, the first FFT processing unit 1211, the second FFT processing unit 1212, the detecting unit 1220, the correction coefficient unit 1230, the correcting unit 1240, the level difference calculating unit 1250, the control coefficient unit 1260, the level control unit 1270, the IFFT processing unit 1280, and a threshold unit 1290 for deriving the first threshold thre1 and the second threshold thre2.

The signal processing for sound signals performed by various functions illustrated in FIG. 6 is described. The sound processing mechanism 120 generates sound signals X1(*f*) and X2(*f*) which are converted into components on the frequency axis by the processes performed by the first framing unit 1201, the second framing unit 1202, the first FFT processing unit 1211 and the second FFT processing unit 1212.

The threshold unit 1290 performs a smoothing process in the direction of the time axis for the amplitude spectrum |X2(*f*)| of the sound signal X2(*f*) concerning the second sound input mechanism 102, to calculate an amplitude spectrum |N(f)| of a stationary noise. Calculation of the amplitude spectrum |N(f)| of a stationary noise is based on the assumption that the voice by a speaker is produced intermittently whereas the stationary noise is generated continuously.

Moreover, on the assumption that a component based on the voice produced by a speaker is included in the amplitude spectrum $|X2(f)|$ of the sound signal $X2(f)$ concerning the frequency f satisfying the condition indicated in the formula (9) below, the threshold unit 1290 obtains the phase difference $\tan^{-1}(X1(f)/X2(f))$ between the sound signal $X1(f)$ concerning the first sound input mechanism 101 and the sound signal $X2(f)$ concerning the second sound input mechanism 102, and detects the arrival direction of the voice produced by a speaker based on the phase difference $\tan^{-1}(X1(f)/X2(f))$.

$$|X2(f)|>\beta\cdot|N(f)| \quad \text{formula (9)}$$

wherein β: a constant satisfying β>1

The threshold unit 1290 then dynamically sets the first threshold value thre1 and the second threshold value thre2 for the sound signals $X1(f)$ and $X2(f)$ concerning components of the sounds with the detected arrival direction of voice in the range of a given angle A2 on the basis of the direction of the straight line determined by the arrangement positions of the first sound input mechanism 101 and the second sound input mechanism 102. Accordingly, inappropriate suppression of voice may be prevented as long as the detected arrival direction of voice is in the range of a given angle $\tan^{-1}$ (A2) from the direction of the straight line determined by the arrangement positions of the first sound input mechanism 101 and the second sound input mechanism 102. If the first threshold value thre1 and the second threshold value thre2 are fixed, the phase difference between the sound arriving at the first sound input mechanism 101 and the sound arriving at the second input mechanism 102 becomes smaller when the arrival direction of voice is inclined from the direction of the straight line determined by the arrangement positions of the first sound input mechanism 101 and the second sound input mechanism 102, which increases the level difference diff(f) while the control coefficient gain(f) becomes smaller, causing inappropriate suppression for the voice.

Figure 7:
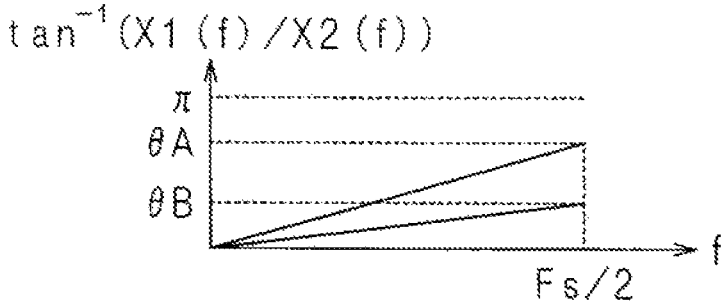
FIG. 7 is a graph for obtaining a phase difference in the sound processing device according to Embodiment 2.

FIG. 7 is a graph for obtaining the phase difference $\tan^{-1}(X1(f)/X2(f))$ in the sound processing device 1 according to Embodiment 2. FIG. 7 illustrates the relationship between frequency f indicated on the horizontal axis and the phase difference $\tan^{-1}(X1(f)/X2(f))$ indicated on the vertical axis. FIG. 7 is a graph for detecting the arrival direction of a voice produced by a speaker as the phase difference $\tan^{-1}(X1(f)/X2(f))$. The threshold unit 1290 approximates, for the frequency f at which the peak of the amplitude spectrum $|X2(f)|$ of the sound signal $X2(f)$ concerning the second sound input mechanism 102 satisfies the condition indicated in the formula (9) above, the relationship between the frequency f and the phase difference $\tan^{-1}(X1(f)/X2(f))$ between the sound signal $X1(f)$ concerning the first sound input mechanism 101 and the sound signal $X2(f)$ concerning the second sound input mechanism 102 for the frequency f as a straight line passing the origin of coordinates indicated in FIG. 7. Because of the nature of sound, the relationship between the frequency f and the phase difference $\tan^{-1}(X1(f)/X2(f))$ for the sound arriving from the sound source may be approximated as a straight line passing the origin of coordinates on the graph defined by the frequency f and the phase difference $\tan^{-1}(X1(f)/X2(f))$. Thus, the inclination of the approximate straight line indicates the direction from which a sound is arriving.

The threshold unit 1290 derives, at the obtained approximate straight line, the phase difference $\tan^{-1}(X1(f)/X2(f))$ at standard frequency Fs/2, which is a half the value of the sampling frequency fs, as a standard phase difference θs. The threshold unit 1290 compares the standard phase difference θs with an upper-limit phase difference θA and a lower-limit phase difference θB that have been preset, to determine whether or not the arrival direction of a voice is within the range of a given angle $\tan^{-1}$ (A2) on the basis of the straight line determined by the arrangement positions of the first sound input mechanism 101 and the second sound input mechanism 102. The upper-limit phase difference θA is set based on the phase difference occurring due to the interval between the first sound input mechanism 101 and the second sound input mechanism 102 generated when the arrival direction of a voice is on the straight line determined by the arrangement positions of the first sound input mechanism 101 and the second sound input mechanism 102. The lower-limit phase difference θB is set based on the phase difference generated when the arrival direction of a voice is inclined from the direction of the straight line by a given angle $\tan^{-1}$ (A2). The threshold unit 1290 determines that the arrival direction of a voice is in the range of a given angle $\tan^{-1}$ (A2) from the direction of the straight line determined by the arrangement positions of the first sound input mechanism 101 and the second sound input mechanism 102 when the standard phase difference θs is smaller than the upper-limit phase difference θA and equal to or larger than the lower-limit phase difference θB.

Figure 8:
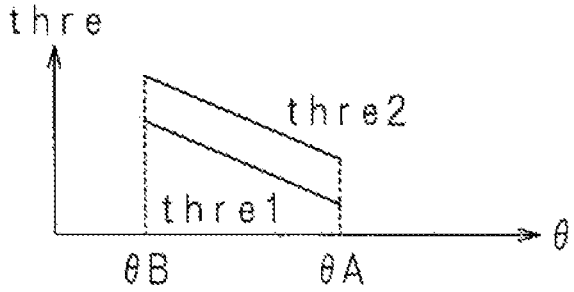
FIG. 8 is a graph for obtaining a first threshold value and a second threshold value in the sound processing device according to Embodiment 2.

FIG. 8 is a graph for obtaining the first threshold value thre1 and the second threshold value thre2 in the sound processing device 1 according to Embodiment 2. FIG. 8 illustrates the relationship between the phase difference θ indicated on the horizontal axis and the threshold thre indicated on the vertical axis. FIG. 8 is a graph for deriving the first threshold value thre1 and the second threshold value thre2 from the standard phase difference which is smaller than the upper-limit phase difference θA and is equal to or larger than the lower-limit phase difference θB. The threshold unit 1290 derives the first threshold thre1 from the relationship between the standard phase difference θs obtained as illustrated in FIG. 7 and the line indicated as thre1 in FIG. 8, and derives the second threshold thre2 from the relationship between the standard phase difference θs and the line indicated as thre2. The threshold unit 1290 then sets the derived first threshold thre1 and the second threshold thre2 as the first threshold thre1 and the second threshold 2 for the sound signals $X1(f)$ and $X2(f)$ concerning the frequency f. The first threshold thre1 and the second threshold thre2 are dynamically set for the sound signals $X1(f)$ and $X2(f)$ at the frequency f when the standard phase difference θs is smaller than the upper-limit phase difference θA and equal to or larger than the lower-limit phase difference θB.

The sound processing mechanism 120 then executes processes by the detecting unit 1220, the correction coefficient unit 1230, the correcting unit 1240, the level difference calculating unit 1250, the control coefficient unit 1260, the level control unit 1270 and the IFFT processing unit 1280, to output the sound signal xout(t). If the first threshold thre1 and the second threshold thre2 derived by the threshold unit 1290 are set for the frequency f at which the control coefficient gain(f) is to be obtained, the control coefficient unit 1260 obtains the control coefficient gain(f) using the first threshold thre1 and the second threshold thre2 that have been set. Note that, the more the arrival direction of a voice inclines from the straight line determined by the arrangement positions of the first sound input mechanism 101 and the second sound input mechanism 102, the smaller the standard phase difference θs becomes and the larger the first threshold thre1 and the second threshold thre2 become. Hence, the graph illustrated in FIG. 4 makes transition toward the right-hand direction of FIG. 4.

Figure 9:
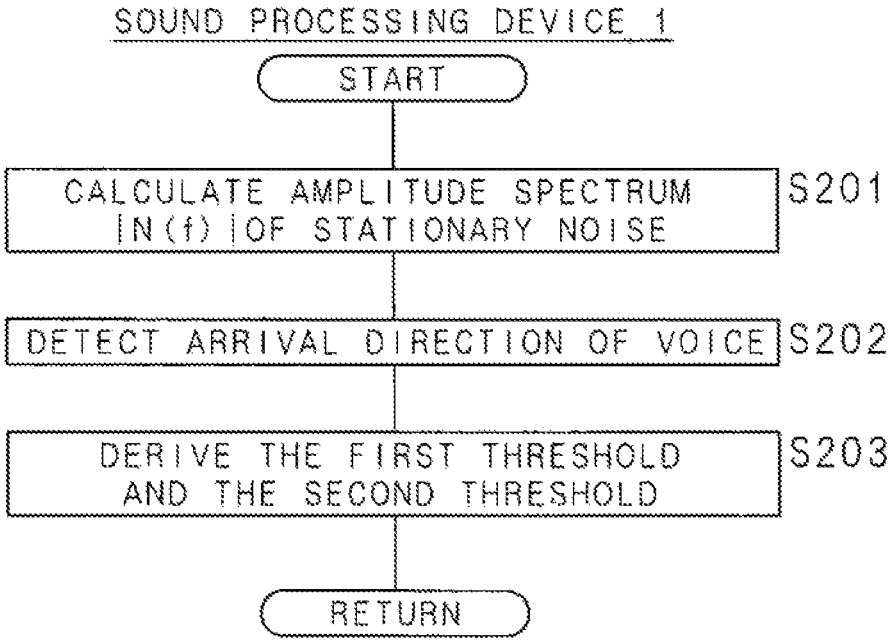
FIG. 9 is an operation chart illustrating an example of a process of setting a threshold in the sound processing device according to Embodiment 2.

Next, the processes performed by the sound processing device 1 according to Embodiment 2 will be described. FIG. 9 is an operation chart illustrating an example of a process for setting a threshold in the sound processing device 1 according to Embodiment 2. The sound processing device 1 according to Embodiment 2 executes the basic process described in Embodiment 1, and further executes a threshold-setting process in parallel with the executed process. The sound processing mechanism 120 included in the sound processing device 1 performs, by the threshold unit 1290, a smoothing process in the direction of the time axis for the amplitude spectrum $|X2(f)|$ of the sound signal $X2(f)$ concerning the second sound input mechanism 102, which has been converted into a signal on the frequency axis at the operation S103 in the basic process, to calculate the amplitude spectrum $|N(f)|$ of a stationary noise (S201).

The sound processing mechanism 120 included in the sound processing device 1 detects, by the threshold unit 1290, the arrival direction of the voice produced by a speaker based on the phase difference $\tan^{-1}(X1(f)/X2(f))$ for the frequency f at which the peak of the amplitude spectrum $|X2(f)|$ satisfies the condition in the formula (9) above (S202), and derives the first threshold thre1 and the second threshold thre2 when the detected arrival direction of voice is in the range of a given angle $\tan^{-1}(A2)$ from the direction of the straight line determined by the arrangement positions of the first sound input mechanism 101 and the second sound input mechanism 102 (S203). At the operation S203, the derived first threshold thre1 and second threshold thre2 are used in the process of obtaining the control coefficient gain(f) by the control coefficient unit 1260 at the operation S108 in the basic process. Moreover, the process of deriving the first threshold thre1 and the second threshold thre2 at the operation S203 is executed only when the arrival direction of a voice produced by a speaker is in the range of a given angle $\tan^{-1}(A2)$ from the direction of the straight line determined by the arrangement positions of the first sound input mechanism 101 and the second sound input mechanism 102.

When it is mounted in a device portable by a speaker of a to mobile phone, for example, the present embodiment may appropriately execute a process based on the technique using the present embodiment even if the mouth of a speaker is somewhat inclined from the direction supposed at the time of designing. Accordingly, the function by an executed process may appropriately be expressed regardless of the posture of a speaker, presenting a beneficial effect.

Embodiment 3

Embodiment 3 is an example where, in Embodiment 1, a plurality of directions to target sound sources are provided. For example, if a computer incorporated in a system, such as a conference system in which a plurality of people are seated separately around a table, is used as a sound processing device of the present embodiment, the sound processing device is arranged at the center of the table so as to process voices arriving from a plurality of directions as target sound sources. In the description below, the parts similar to those in Embodiment 1 are denoted by reference symbols similar to those in Embodiment 1, and will not be described in detail.

Figure 10:
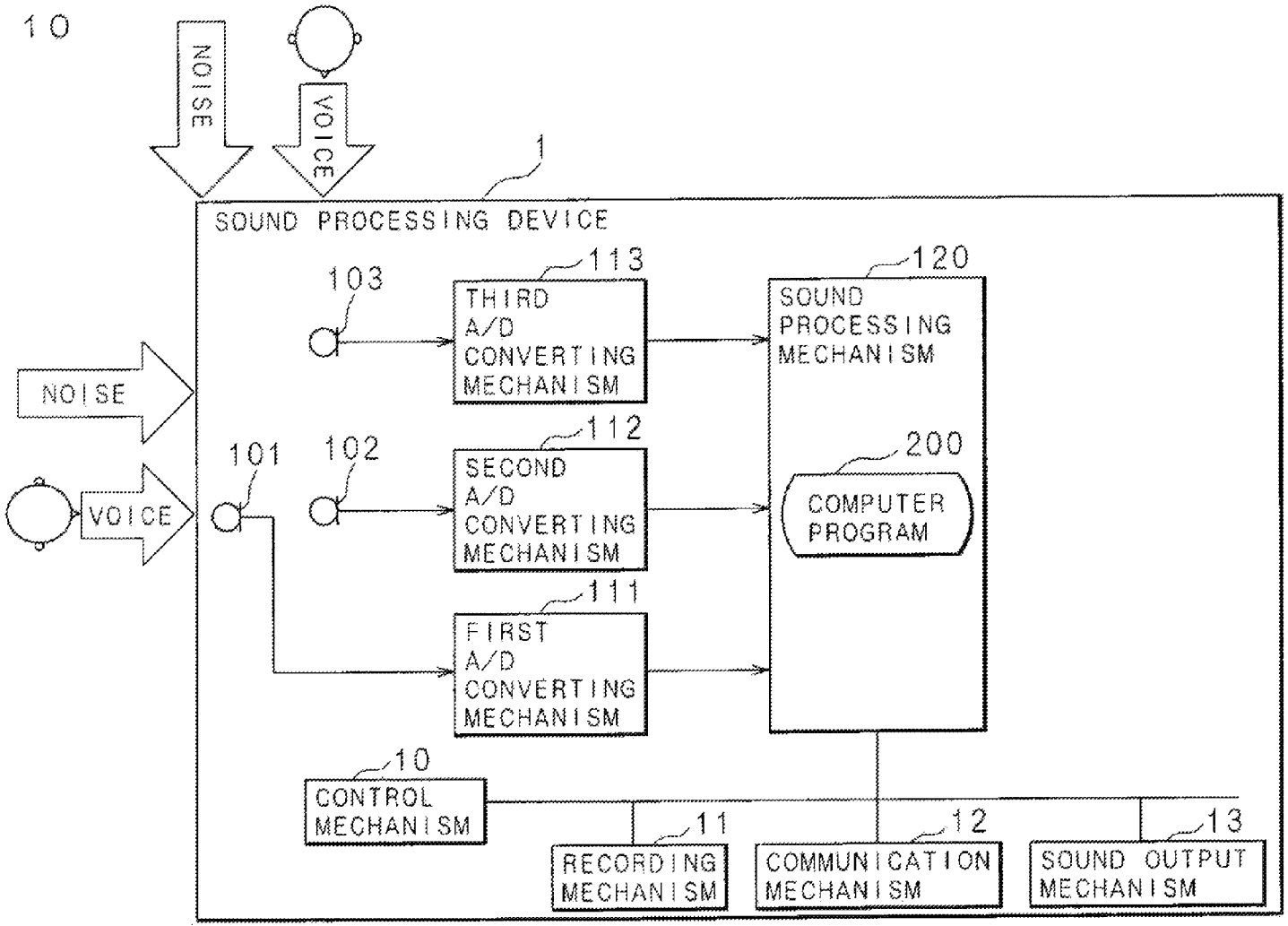
FIG. 10 is a block diagram schematically illustrating an example of a sound processing device according to Embodiment 3.

FIG. 10 is a block diagram schematically illustrating an example of the sound processing device 1 according to Embodiment 3. The sound processing device 1 according to Embodiment 3 is a device used in a system such as a conference system in which there are speakers in a plurality of directions. The sound processing device 1 includes the first sound input mechanism 101, the second sound input mechanism 102, a third sound input mechanism 103, the first A/D converting mechanism 111, the second A/D converting mechanism, a third A/D converting mechanism 113 and the sound processing mechanism 120. The sound processing mechanism 120 incorporates therein firmware such as the computer program 200 of the present embodiment as well as data, and executes the computer program 200 incorporated therein as firmware to make the computer function as the sound processing device 1 of the present embodiment.

The first sound input mechanism 101, the second sound input mechanism 102 and the third sound input mechanism 103 are arranged so as not to be lined up on the same straight line. They are arranged such that the first speaker is positioned on a half line extending from the second sound input mechanism 102 to the first sound input mechanism 101, while the second speaker is positioned on a half line extending from the second sound input mechanism 102 to the third sound input mechanism 103. Thus, the sound processing device 1 according to Embodiment 3 executes a process for the voice produced by the first speaker based on the sound input to the first sound input mechanism 101 and the second sound input mechanism, and executes a process for the voice produced by the second speaker based on the sound input to the second sound input mechanism 102 and the third sound input mechanism 103.

The sound processing device 1 further includes various mechanisms for executing various processes as a conference system, including a control mechanism 10 such as a CPU (Central Processing Unit) for controlling the whole device, a recording mechanism 11 such as a hard disk, ROM or RAM for recording various programs and data, a communication mechanism 12 for connection to a communication network such as a VPN (Virtual Private Network) and a dedicated line network, and a sound output mechanism 13 such as a loudspeaker for outputting a sound.

Figure 11:
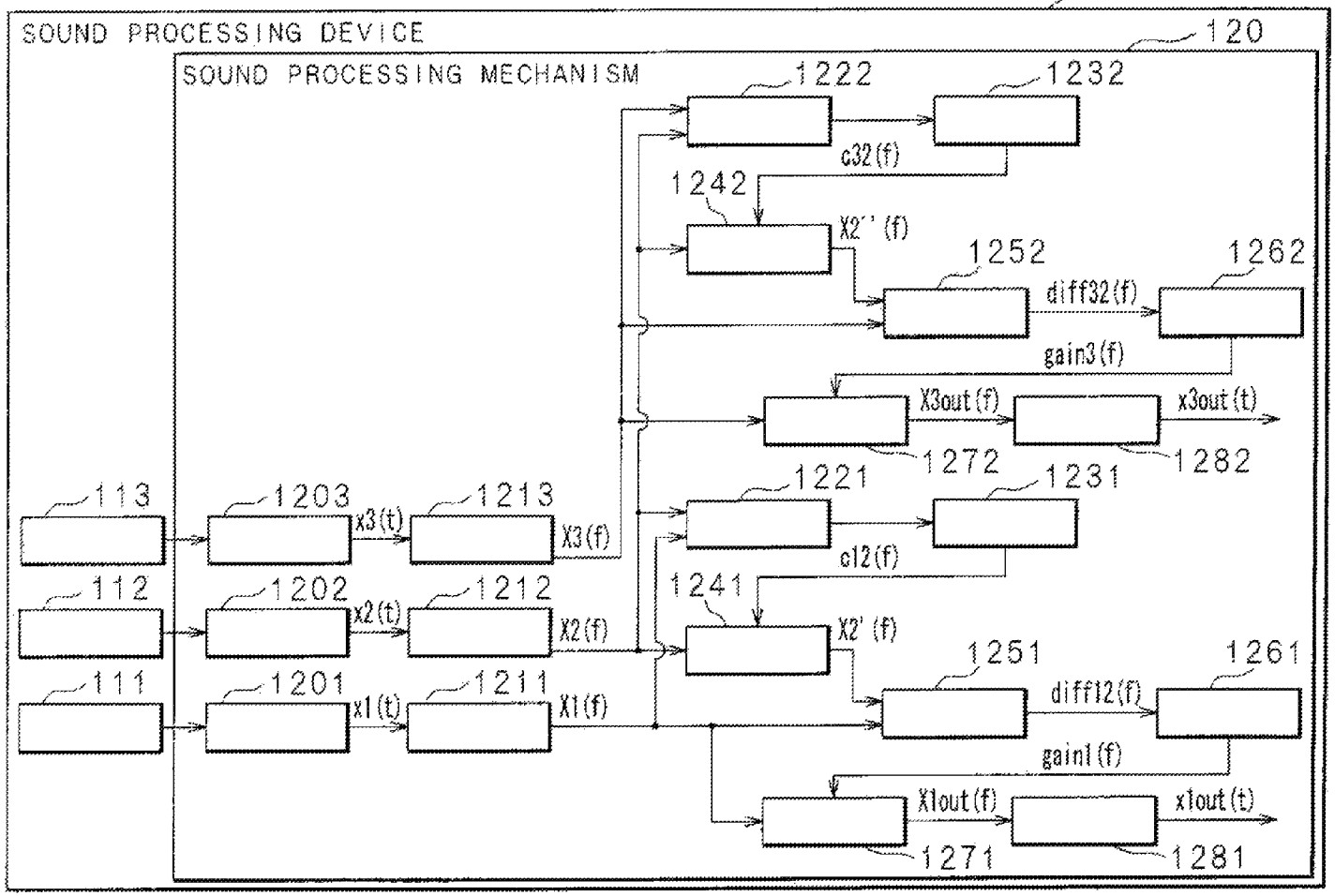
FIG. 11 is a functional block diagram illustrating an example of a sound processing mechanism included in the sound processing device according to Embodiment 3.

FIG. 11 is a functional block diagram illustrating an example of the sound processing mechanism 120 included in the sound processing device 1 according to Embodiment 3. The sound processing mechanism 120 executes the computer program 200 to generate various program modules such as the first framing unit 1201, the second framing unit 1202, a third framing unit 1203, the first FFT processing unit 1211, the second FFT processing unit 1212, a third FFT processing unit 1213, the first detecting unit 1221, the second detecting unit 1222, a first correction coefficient unit 1231, a second correction coefficient unit 1232, a first correcting unit 1241, a second correcting unit 1242, a first level difference calculating unit 1251, a second level difference calculating unit 1252, a first control coefficient unit 1261, a second control coefficient unit 1262, a first level control unit 1271, a second level control unit 1272, a first IFFT processing unit 1281 and a second IFFT processing unit 1282.

The signal processing for sound signals performed by various functions illustrated in FIG. 11 will be described. The sound processing mechanism 120 receives sound signals $x1(t)$, $x2(t)$ and $x3(t)$, which are digital signals, from the first A/D converting mechanism 111, the second A/D converting mechanism 112 and the third A/D converting mechanism 113. The first framing unit 1201, the second framing unit 1202 and the third framing unit 1203 frame the received sound signals $x1(t)$, $x2(t)$ and $x3(t)$, and the first FFT processing unit 1211, the second FFT processing unit 1212 and the third FFT processing unit 1213 perform FFT processes to generate sound signals $X1(f)$, $X2(f)$ and $X3(f)$ converted into components on the frequency axis.

The first detecting unit 1221 detects a sound arriving from the direction in the rage of a given angle A1 on the basis of a straight line determined by the arrangement positions of the first sound input mechanism 101 and the second sound input mechanism 102, based on the sound signals X1(*f*) and X2(*f*). The first correction coefficient unit 1231 obtains a first correction coefficient c12(*f*) based on the detected components of the sound signals X1(*f*) and X2(*f*) concerning the frequency f. The first correcting unit 1241 corrects the level of the sound signal X2(*f*) concerning the second sound input mechanism 102 based on the first correction coefficient c12(*f*).

Moreover, the first level difference calculating unit 1251 calculates a level difference diff12(*f*) between the sound signal X1(*f*) concerning the first sound input mechanism 101 and the sound signal X2'(*f*), obtained after correction, concerning the second sound input mechanism 102. The first control coefficient unit 1261 obtains a first control coefficient gain1(*f*) based on the level difference diff12(*f*). The first level control unit 1271 controls the level of the sound signal X1(*f*) concerning the first sound input mechanism 101 based on the first control coefficient gain1(*f*). The first IFFT processing unit 1281 converts a sound signal X1out(f), with the level controlled, into a sound signal x1out(t) which is a signal on a time axis by the IFFT process. The sound processing device 1 then executes various processes such as communication and output based on the sound signal x1out(t).

The second detecting unit 1222 detects the sound arriving from within the range of a given angle A3 on the basis of the straight line determined by the arrangement positions of the third sound input mechanism 103 and the second sound input mechanism 102 based on the sound signals X3(*f*) and X2(*f*). The second correction coefficient unit 1232 obtains a second correction coefficient c32(*f*) based on the detected components of the sound signals X3(*f*) and X2(*f*) concerning the frequency f. The second correcting unit 1242 corrects the level of the sound signal X2(*f*) concerning the second sound input mechanism 102 based on the second correction coefficient c32(*f*).

Moreover, the second level difference calculating unit 1252 calculates a level difference diff32(*f*) between the sound signal X3(*f*) concerning the third sound input mechanism 103 and a sound signal X2"(*f*), obtained after correction, concerning the second sound input mechanism 102. The second control coefficient unit 1262 obtains a second control coefficient gain3(*f*) based on the level difference diff32(*f*). The second level control unit 1272 controls the level of the sound signal X3(*f*) concerning the third sound input mechanism 103 based on the second control coefficient gain3(*f*). The second IFFT processing unit 1282 converts the sound signal X3out(f), with the level controlled, into a sound signal x3out(t) which is a signal on the time axis by the IFFT process. The sound processing device 1 then executes various processes such as communication and output based on the sound signal x3out (t).

As described above, Embodiment 3 is an example where the processes for sound signals executed in Embodiment 1 are performed for each of the groups, one group including the sound signals concerning the first sound input mechanism 101 and the second input mechanism 102, and the other group including the sound signals concerning the second sound input mechanism 102 and the third sound input mechanism 103. The first sound input mechanism 101, the second sound input mechanism 102 and the third sound input mechanism 103 function as a microphone array having directivity for each straight line determined by two sound input mechanisms.

Since the process by the sound processing device 1 according to Embodiment 3 is for performing the process of the sound processing device 1 according to Embodiment 1 for each group described above, reference shall be made to Embodiment 1, and description thereof will not be repeated here.

Though Embodiment 3 above described an example where three sound input mechanisms are used, the present embodiment is not limited thereto. It may be developed to various forms such that four or more sound input mechanisms may be used. Moreover, when four or more sound input mechanisms are used, it is not always necessary to employ a sound input mechanism that is common to a plurality of groups.

The present embodiment may address the case where a plurality of target sound sources exist on a plurality of straight lines by so arranging three or more sound input units as not to be lined up on the same straight line. When, for example, it is applied to a conference system in which several people are seated separately around a table, a device based on the technique using the present embodiment is arranged at the center of the table to appropriately process the voice of each person, presenting a beneficial effect.

Embodiment 4

Embodiment 4 is an example where Embodiment 3 is combined with Embodiment 2. In the description below, the parts similar to those in Embodiments 1 to 3 are denoted by reference symbols similar to those of Embodiments 1 to 3, and will not be described in detail.

Figure 12:
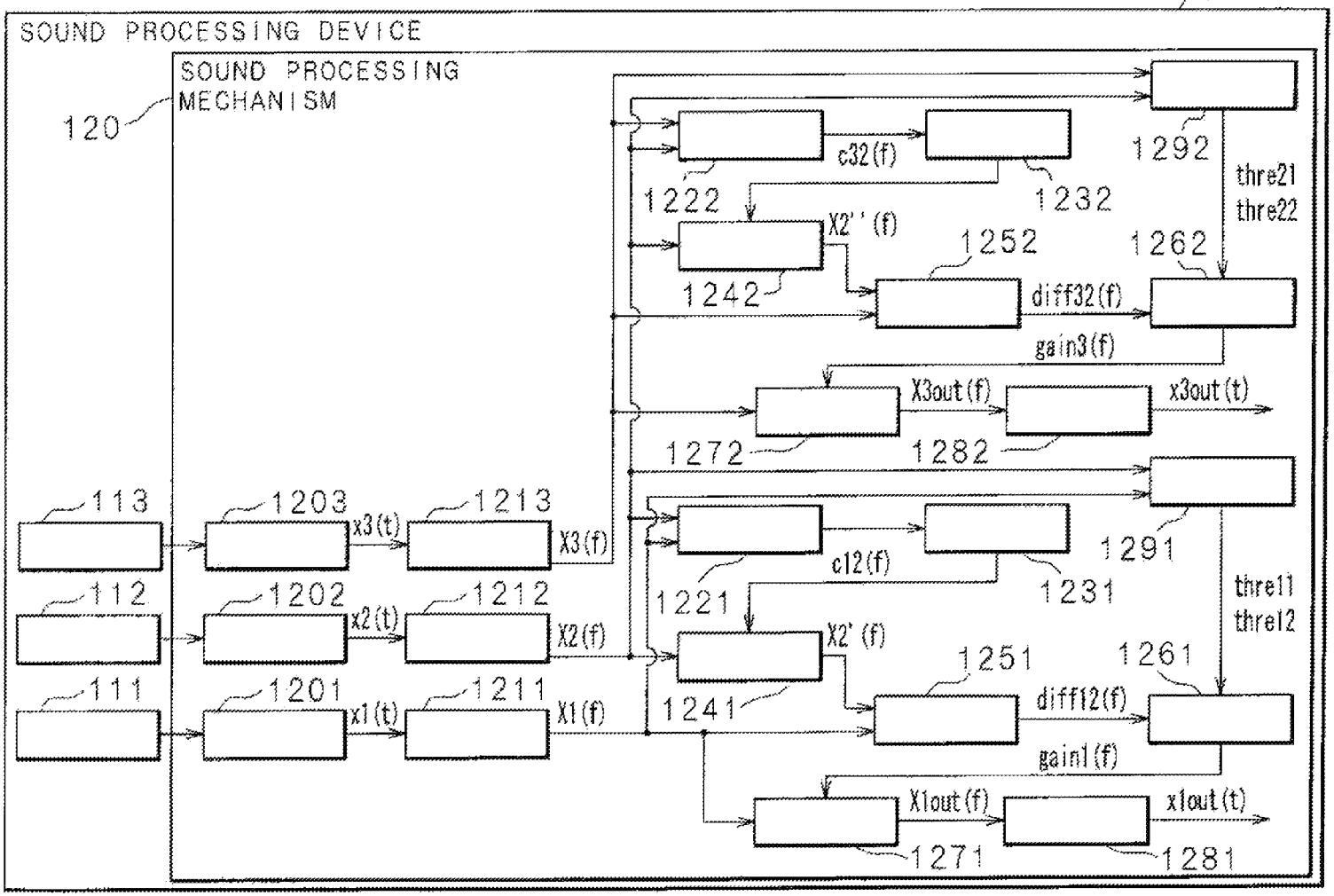
FIG. 12 is a functional block diagram illustrating an example of a sound processing mechanism included in a sound processing device according to Embodiment 4.

Since the example of the sound processing device 1 according to Embodiment 4 is similar to that in Embodiment 1, reference shall be made to Embodiment 1 and description thereof will not be repeated here. FIG. 12 is a functional block diagram illustrating an example of the sound processing mechanism 120 included in the sound processing device 1 according to Embodiment 4. The sound processing mechanism 120 executes the computer program 200 to generate various program modules such as the first framing unit 1201, the second framing unit 1202, the third framing unit 1203, the first FFT processing unit 1211, the second FFT processing unit 1212, the third FFT processing unit 1213, the first detecting unit 1221, the second detecting unit 1222, the first correction coefficient unit 1231, the second correction coefficient unit 1232, the first correcting unit 1241, the second correcting unit 1242, the first level difference calculating unit 1251, the second level difference calculating unit 1252, the first control coefficient unit 1261, the second control coefficient unit 1262, the first level control unit 1271, the second level control unit 1272, the first IFFT processing unit 1281, the second IFFT processing unit 1282, a first threshold unit 1291 and a second threshold unit 1292.

The signal processing for sound signals performed by various functions illustrated in FIG. 12 is described. The sound processing mechanism 120 generates sound signals X1(*f*), X2(*f*) and X3(*f*), which are converted into components on the frequency axis, by the processes performed by the first framing unit 1201, the second framing unit 1202, the third framing unit 1203, the first FFT processing unit 1211, the second FFT processing unit 1212 and the third FFT processing unit 1213.

The first threshold unit 1291 derives a first threshold for the first group thre11 and a second threshold for the first group thre12 based on the sound signal X1(*f*) concerning the first sound input mechanism 101 and the sound signal X2(*f*) concerning the second sound input mechanism 102.

The sound processing mechanism 120 then executes the processes by the first detecting unit 1221, the first correction coefficient unit 1231, the first correcting unit 1241, the first level difference calculating unit 1251, the first control coefficient unit 1261, the first level control unit 1271 and the first IFFT processing unit 1281, to output the sound signal x1out (t). If the first threshold for the first group thre11 and the second threshold for the first group thre12 derived by the first threshold unit 1291 are set for the frequency f at which the first control coefficient gain1(*f*) is to be obtained, the first control coefficient unit 1261 obtains the control coefficient gain1(*f*) using the first threshold for the first group thre11 and the second threshold for the first group thre12 that have been set.

The second threshold unit 1292, on the other hand, derives a first threshold for the second group thre21 and a second threshold for the second group thre22 based on the sound signal X3(*f*) concerning the third sound input mechanism 103 and the sound signal X2(*f*) concerning the second sound input mechanism 102.

The sound processing mechanism 120 then executes the processes by the second detecting unit 1222, the second correction coefficient unit 1232, the second correcting unit 1242, the second level difference calculating unit 1252, the second control coefficient unit 1262, the second level control unit 1272 and the second IFFT processing unit 1282, to output the sound signal x3out(t). If the first threshold for the second group thre21 and the second threshold for the second group thre22 derived by the second threshold unit 1292 are set for the frequency f at which the second control coefficient gain3(*f*) is to be obtained, the second control coefficient unit 1262 obtains the control coefficient gain3(*f*) using the first threshold for the second group thre21 and the second threshold for the second group thre22 that have been set.

Since the processes by the sound processing device 1 according to Embodiment 4 are for performing the processes of the sound processing device 1 according to Embodiment 1 and Embodiment 2 for each group described above, reference shall be made to Embodiment 1 and Embodiment 2, and description thereof will not be repeated here.

Embodiment 5

Embodiment 5 is an example where the sound processing device described in Embodiment 1 is applied as a correcting device, which is built into or connected to a sound input device such as a microphone array device, for correcting a sound signal generated by the sound input device.

Figure 13:
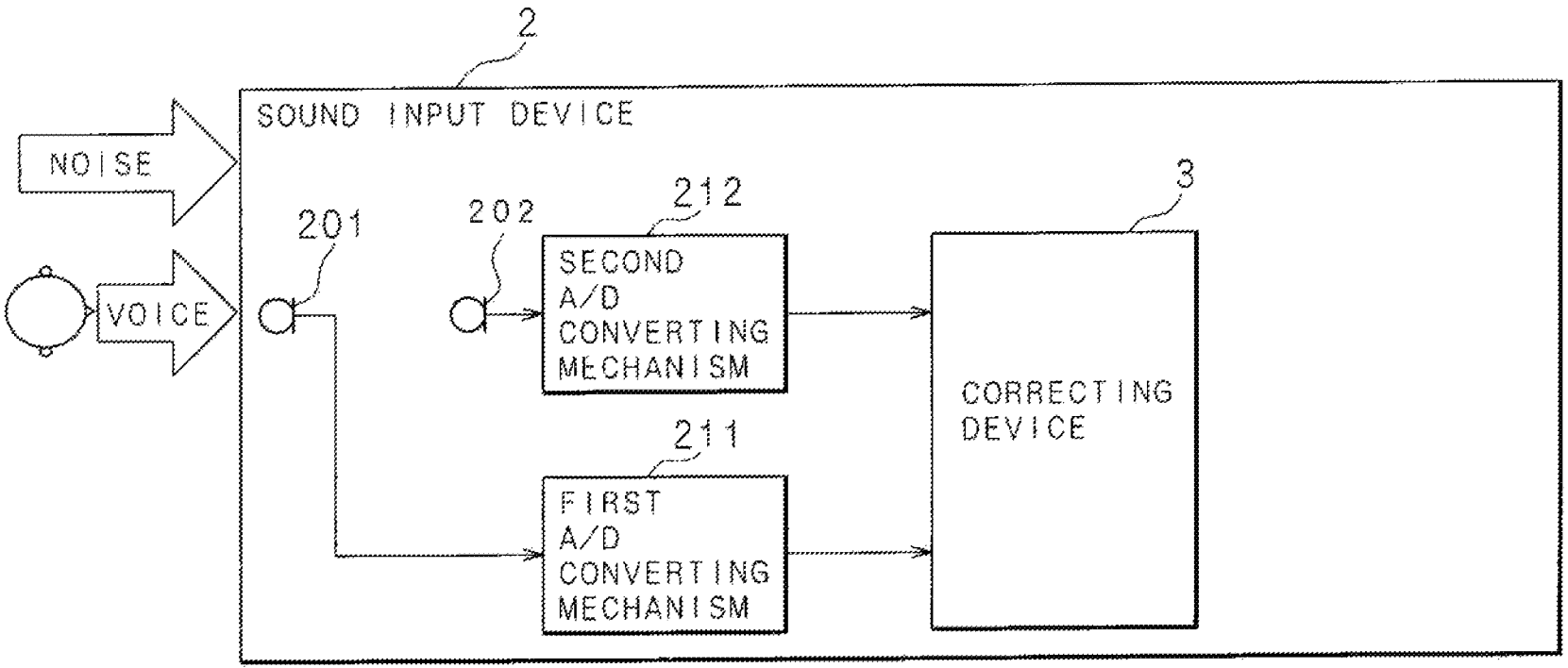
FIG. 13 is a block diagram schematically illustrating examples of a sound input device and a correcting device according to Embodiment 5.

FIG. 13 is a block diagram schematically illustrating examples of a sound input device and a correcting device according to Embodiment 5. The sound input device such as a microphone array device is denoted by 2 in FIG. 13. The sound input device 2 incorporates therein the correcting device 3 using a chip such as VLSI for correcting the sound signal generated by the sound input device 2. Note that the correcting device 3 may be a device externally connected to the sound input device 2.

The sound input device 2 includes a first sound input mechanism 201 and a second sound input mechanism 202, as well as a first A/D converting mechanism 211 and a second A/D converting mechanism 212 for performing A/D conversion on sound signals. Each of the first sound input mechanism 201 and the second sound input mechanism 202 generates a sound signal which is an analog signal based on the input sound. Each of the first A/D converting mechanism 211 and the second A/D converting mechanism 212 amplifies and filters the input sound signal, and converts the signal into a digital signal to output it to the correcting device 3.

Figure 14:
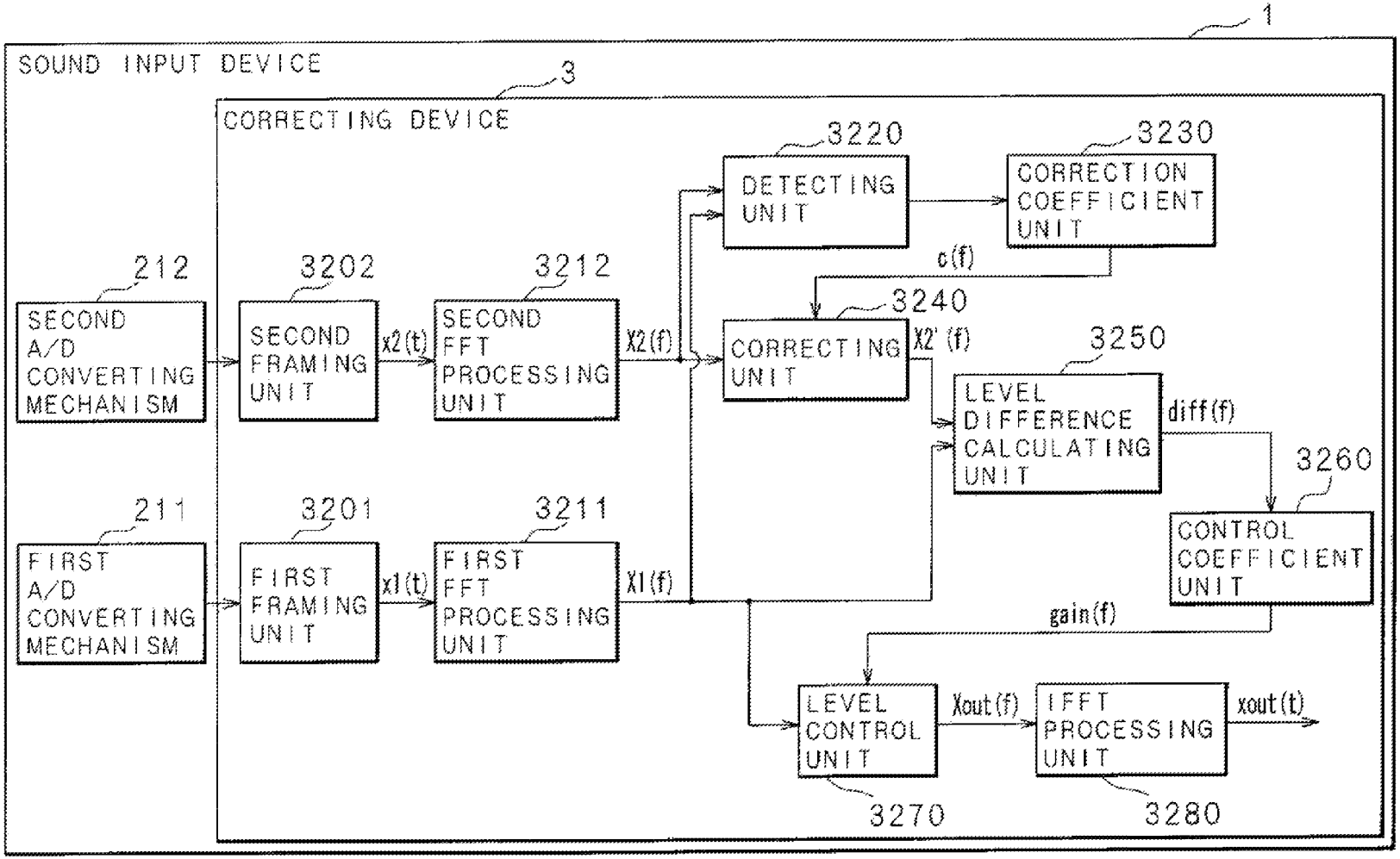
FIG. 14 is a functional block diagram illustrating an example of a correcting device according to Embodiment 5.

FIG. 14 is a functional block diagram illustrating an example of the correcting device 3 according to Embodiment 5. The correcting device 3 executes various program modules such as a first framing unit 3201, a second framing unit 3202, a first FFT processing unit 3211, a second FFT processing unit 3212, a detecting unit 3220, a correction coefficient unit 3230, a correcting unit 3240, a level difference calculating unit 3250, a control coefficient unit 3260, a level control unit 3270 and an IFFT processing unit 3280. Since the functions and processes of the program modules are similar to those in Embodiment 1, reference shall be made to Embodiment 1 and description thereof will not be repeated here.

While Embodiments 1 to 5 merely illustrate a part of countless embodiments, various hardware and software may be used as appropriate, and various processes other than the described basic processes may also be incorporated.

What is claimed is:

1. A sound processing device, comprising:

a plurality of sound input units to which a sounds is input and from which sound signals are generated;

a calculating unit for calculating a phase difference between a sound signal generated from a first sound input unit among the plurality of sound input units and a sound signal generated from a second sound input unit among the plurality of sound input units;

a detecting unit for detecting, in accordance with the phase difference calculated by the calculating unit, whether or not the sound arrives from a direction approximately perpendicular to a line determined by arrangement positions of the first sound input unit and the second input unit;

a correction coefficient unit for obtaining a correction coefficient, based on the detecting of the detecting unit, to be used for correcting an amplitude level of at least one of the sound signals generated from the first sound input unit and the second input unit;

a correcting unit for correcting the amplitude level of at least said one of the sound signals using the obtained correction coefficient; and a processing unit for performing a sound process based on the sound signals after the correcting unit corrected the amplitude level, wherein the correction coefficient obtained by the correction coefficient unit when the detecting unit detects that the sound arrives from the direction approximately perpendicular to the line is different from the correction coefficient obtained by the correction coefficient unit when the detecting unit detects that the sound does not arrive from the direction approximately perpendicular to the line, and the correction coefficient unit obtains the correction coefficient through a formula $$c(f, n)=a\cdot c(f, n-1)+(1-a)\cdot(|X1(f, n)|/|X2(f, n)|)$$

where f is a frequency, c(f, n) is a correction coefficient, $0\leq a<1$, n is a frame number, and $|X1(f, n)|/|X2(f, n)|$ is a ratio of amplitude spectra for sound signals.

2. The sound processing device according to claim 1, wherein, when the arrival direction of the sound detected by the detecting unit is in a range of a given angle from a direction perpendicular to the line determined by the arrangement positions of the first sound input unit and the second sound input unit, the correction coefficient unit obtains a correction coefficient, and the correcting unit corrects the level.

3. The sound processing device according to claim 1, wherein the processing unit includes a difference calculating unit for calculating a level difference between sound signals corrected by the correcting unit, a control coefficient unit for obtaining a control coefficient to be used for controlling the level of the sound signal generated by the first sound input unit based on the calculated level difference, and a level control unit for controlling the level of the sound signal generated by the first sound input unit using the obtained control coefficient.

4. The sound processing device according to claim 1, wherein the processing unit performs a sound process for a sound signal concerning a frequency component of a sound with the arrival direction in the range of a given angle from the direction of the line determined by the arrangement positions of the first sound input unit and the second sound input unit.

5. A sound processing device, comprising:

three or more sound input units, to which sounds is input and from which sound signals are generated, arranged so as not to be lined up along a same line, a first calculating unit for calculating a phase difference between a sound signal generated from a first sound input unit among the sound input units and a sound signal generated from a second sound input unit among the sound input units;

a second calculating unit for calculating a phase difference between a sound signal generated from the second sound input unit and a sound signal generated from a third sound input unit among the sound input units;

a first detecting unit for detecting, in accordance with the phase difference calculated by the first calculating unit, whether or not the sound arrives from a direction approximately perpendicular to a line determined by arrangement positions of the first sound input unit and the second sound input unit;

a second detecting unit for detecting, in accordance with the phase difference calculated by the second calculating unit, whether or not the sound arrives from a direction approximately perpendicular to a line determined by arrangement positions of the second sound input unit and the third sound input unit;

a first correction coefficient unit for obtaining a first correction coefficient, based on the detecting of the first detecting unit, to be used for correcting an amplitude level of the sound signals generated from the first sound input unit;

a second correction coefficient unit for obtaining a second correction coefficient, based on the detecting of the second detecting unit, to be used for correcting an amplitude level of the sound signals generated from the third sound input unit;

a first correcting unit for correcting the amplitude level of the sound signals generated from the first sound input unit, based on the first correction coefficient obtained by the first correction coefficient unit;

a second correcting unit for correcting the amplitude level of the sound signals generated from the third sound input unit, based on the second correction coefficient obtained by the second correction coefficient unit;

a first processing unit for performing a sound process based on a the sound signal whose amplitude level was corrected by the first correcting unit; and a second processing unit for performing a sound process based on a the sound signal whose amplitude level was corrected by the second correcting unit, wherein the first correction coefficient obtained by the first correction coefficient unit when the first detecting unit detects that the sound arrives from the direction approximately perpendicular to the line is different from the first correction coefficient obtained by the first correction coefficient unit when the first detecting unit detects that the sound does not arrive from the direction approximately perpendicular to the line, and the second correction coefficient obtained by the second correction coefficient unit when the second detecting unit detects that the sound arrives from the direction approximately perpendicular to the line is different from the second correction coefficient obtained by the second correction coefficient unit when the second detecting unit detects that the sound does not arrive from the direction approximately perpendicular to the line.

6. The sound processing device according to claim 5, wherein, when the arrival direction of the sound detected by the first detecting unit is in the range of a given angle from the direction perpendicular to the first line, the first correction coefficient unit obtains a correction coefficient, and the first correcting unit corrects the level, and wherein, when the arrival direction of the sound detected by the second detecting unit is in the range of a given angle from the direction perpendicular to the second line, the second correction coefficient unit obtains a correction coefficient, and the second correcting unit corrects the level.

7. The sound processing device according to claim 5, wherein the first processing unit includes a first difference calculating unit for calculating the level difference between the sound signals corrected by the first correcting unit, a first control coefficient unit for obtaining a control coefficient to be used for controlling the level of the sound signal generated by the first sound input unit, which is one of the two sound input units on the first line, based on the level difference calculated by the first difference calculating unit, and a first level control unit for controlling the level of the sound signal generated by the first sound input unit using the control coefficient obtained by the first control coefficient unit, and wherein the second processing unit includes a second difference calculating unit for calculating a level difference between the sound signals corrected by the second correcting unit, a second control coefficient unit for obtaining a control coefficient to be used for controlling the level of the sound signal generated by a second sound input unit, which is one of the two sound input units on the second line and is different from the first sound input unit, based on the level difference calculated by the second difference calculating unit, and a second level control unit for controlling the level of the sound signal generated by the second sound input unit using the control coefficient obtained by the second control coefficient unit.

8. The sound processing device according to claims 5, wherein the first processing unit performs a sound process for a sound signal concerning a frequency component of a sound with the arrival direction in the range of a given angle from the first line, and the second processing unit performs a sound process for a sound signal concerning a frequency component of a sound with the arrival direction in the range of a given angle from the second line.

9. A correcting device, comprising:

a sound signal obtaining unit for obtaining sound signals from a plurality of sound input units to which a sound is input and from which sound signals are generated;

a calculating unit for calculating a phase difference between a sound signal obtained from a first sound input unit among the plurality of sound input units and a sound signal obtained from a second sound input unit among the plurality of sound input units;

a detecting unit for detecting, in accordance with the phase difference calculated by the calculating unit, whether or not the sound arrives from a direction approximately perpendicular to a straight line determined by arrangement positions of the first sound input unit and the second sound input unit;

a correction coefficient unit for obtaining a correction coefficient, based on the detecting of the detecting unit, to be used for correcting an amplitude level of at least one of the sound signals generated from the first sound input unit and the second sound input unit;

a correcting unit for correcting the amplitude level of at least said one of the sound signals using the obtained correction coefficient; and a outputting unit for outputting a sound process based on the sound signals after the correcting unit corrected the amplitude level, wherein the correction coefficient obtained by the correction coefficient unit when the detecting unit detects that the sound arrives from the direction approximately perpendicular to the line is different from the correction coefficient obtained by the correction coefficient unit when the detecting unit detects that the sound does not arrive from the direction approximately perpendicular to the line, and the correction coefficient unit obtains the correction coefficient through a formula $$c(f, n)=a\cdot c(f, n-1)+(1-a)\cdot(|X1(f, n)|/|X2(f, n)|)$$

where f is a frequency, c(f, n) is a correction coefficient, $0\leq a<1$, n is a frame number, and $|X1(f, n)|/|X2(f, n)|$ is a ratio of amplitude spectra for sound signals.

10. A correcting method, using a computer, for correcting a sound signal generated by a plurality of the sound input units to which a sound is input, comprising:

calculating a phase difference between a sound signal generated by a first sound input unit among the plurality of sound input units and a sound signal generated by a second sound input unit among the plurality of sound input units;

detecting, in accordance with the calculated phase difference, whether or not sound arrives from a direction approximately perpendicular to a straight line determined by arrangement positions of the first sound input unit and the second sound input unit;

obtaining a correction coefficient, based on a result of the detecting, to be used for correcting an amplitude level of at least one of the sound signals generated by the first sound input unit and the second sound input unit, wherein the correction coefficient obtained when it is detected that the sound arrives from the direction approximately perpendicular to the line is different from the correction coefficient obtained when it is detected that the sound does not arrive from the direction approximately perpendicular to the line; and correcting the amplitude level of at least said one of the sound signals using the obtained correction coefficient, wherein the correction coefficient is obtained through a formula $$c(f, n)=a\cdot c(f, n-1)+(1-a)\cdot(|X1(f, n)|/|X2(f, n)|)$$

where f is a frequency, c(f, n) is a correction coefficient, $0\leq a<1$, n is a frame number, and $|X1(f, n)|/|X2(f, n)|$ is a ratio of amplitude spectra for sound signals.

11. A non-transitory computer-readable recording medium storing a program for making a computer correct a sound signal generated by a plurality of the sound input units to which a sound is input, comprising:

calculating, using the computer, a phase difference between a sound signal generated by a first sound input unit among the plurality of sound input units and a sound signal generated by a second sound input unit among the plurality of sound input units;

detecting in accordance with the calculated phase difference, using the computer, whether or not sound arrives from a direction approximately perpendicular to a straight line determined by arrangement positions of the first sound input unit and the second sound input unit;

obtaining in accordance with a result of the detecting, using the computer, a correction coefficient to be used for correcting an amplitude level of at least one of the sound signals generated by the first sound input unit and the second sound input unit, wherein the correction coefficient obtained when it is detected that the sound arrives from the direction approximately perpendicular to the line is different from the correction coefficient obtained when it is detected that the sound does not arrive from the direction approximately perpendicular to the line; and correcting, using the computer, the amplitude level of at least said one of the sound signals using the obtained correction coefficient, wherein the correction coefficient is obtained through a formula $$c(f, n)=a\cdot c(f, n-1)+(1-a)\cdot(|X1(f, n)|/|X2(f, n)|)$$

where f is a frequency, c(f, n) is a correction coefficient, $0\leq a<1$, n is a frame number, and $|X1(f, n)|/|X2(f, n)|$ is a ratio of amplitude spectra for sound signals.

12. The sound processing device according to claim 1, wherein a frequency of the sound detected by the detecting unit satisfies a formula $$|\tan^{-1}(X1(f)/X2(f)|\leq\tan^{-1}(A1)$$

where A1 is a given angle indicating a range of the direction approximately perpendicular to the line determined by arrangement positions of the first sound input unit and the second input unit.

13. The correction device according to claim 9, wherein a frequency of the sound detected by the detecting unit satisfies a formula $$|\tan^{-1}(X1(f)/X2(f)|\leq\tan^{-1}(A1)$$

where A1 is a given angle indicating a range of the direction approximately perpendicular to the line determined by arrangement positions of the first sound input.

14. The correcting method according to claim 10, wherein a frequency of the sound detected by the detecting unit satisfies a formula $|\tan^{-1}(X1(f)/X2(f)|<=\tan^{-1}(A1)$ where A1 is a given angle indicating a range of the direction approximately perpendicular to the line determined by arrangement positions of the first sound input unit and the second input unit.

15. The non-transitory computer-readable recording medium according to claim 10, wherein a frequency of the sound detected by the detecting unit satisfies a formula $|\tan^{-1}(X1(f)/X2(f)|<=\tan^{-1}(A1)$ where A1 is a given angle indicating a range of the direction approximately perpendicular to the line determined by arrangement positions of the first sound input unit and the second input unit.

* * * * *